US008701581B2

(12) United States Patent
Byle et al.

(10) Patent No.: US 8,701,581 B2
(45) Date of Patent: Apr. 22, 2014

(54) SYSTEM AND METHOD FOR THRUSTER PROTECTION DURING TRANSPORT

(75) Inventors: Steven Byle, Sealy, TX (US); James Jun Lee, Katy, TX (US); Anko Gils, Rijsbergen (NL)

(73) Assignee: Delphi Acquisition Holding I B.V., Breda (NL)

( * ) Notice: Subject to any disclaimer, the term of this patent is extended or adjusted under 35 U.S.C. 154(b) by 434 days.

(21) Appl. No.: 13/080,343

(22) Filed: Apr. 5, 2011

(65) Prior Publication Data

US 2011/0265704 A1 Nov. 3, 2011

Related U.S. Application Data

(60) Provisional application No. 61/330,369, filed on May 2, 2010.

(51) Int. Cl.
*B63H 25/42* (2006.01)

(52) U.S. Cl.
USPC ..... 114/151; 114/361

(58) Field of Classification Search
USPC ..... 114/222, 264, 265, 150, 151, 361
See application file for complete search history.

(56) References Cited

U.S. PATENT DOCUMENTS 3,078,680 A * 2/1963 Wepsala ..... 405/209
4,056,073 A * 11/1977 Dashew et al. ..... 114/151
4,208,978 A 6/1980 Eller
4,611,952 A 9/1986 Saint-M'Leuz
5,072,683 A * 12/1991 Colonna ..... 114/222
5,522,335 A 6/1996 Veronesi et al.
5,660,136 A * 8/1997 Pignatelli et al. ..... 114/361
6,056,610 A 5/2000 Fontanille
6,190,091 B1 2/2001 Byle
6,427,577 B1 8/2002 Lee et al.
6,431,107 B1 8/2002 Byle
6,564,735 B1 * 5/2003 Jackson ..... 114/61.1

(Continued)

FOREIGN PATENT DOCUMENTS

EP 0353829 A1 2/1990
JP 2000-272590 A 10/2000
JP 2003-191896 A 7/2003

OTHER PUBLICATIONS

"PCT International Search Report for PCT/US2011/034045", Dec. 19, 2011.

(Continued)

*Primary Examiner* — Edwin Swinehart
(74) *Attorney, Agent, or Firm* — Strasburger & Price, LLP

(57) ABSTRACT

A system and method protect a thruster assembly disposed with a pontoon of a semi-submersible drilling vessel during dry tow transport. A cover may be positioned over the thruster assembly and secured with the pontoon. A thruster cover support structure may be disposed with the pontoon. The thruster cover support structure may be a frame positioned around the pontoon for removable attachment with the thruster cover. The thruster cover support structure may be a bracket, ring or flange fixedly attached with the pontoon. The thruster cover may be removably disposed with the bracket, ring or flange, such as by bolting or welding. A spacer barge may be positioned below the pontoon between thruster assemblies for lifting the semi-submersible drilling vessel before placement of the spacer barge and semi-submersible vessel on the dry tow transporting vessel. The thruster assemblies may be elevated and in some embodiments positioned directly over the dry tow transporting vessel.

12 Claims, 42 Drawing Sheets

(56) References Cited

U.S. PATENT DOCUMENTS

| | | | | |
|---|---|---|---|---|
| 7,146,921 | B2 | 12/2006 | Fontanille et al. | |
| 7,690,320 | B1 * | 4/2010 | Tool | 114/344 |
| 2002/0139286 | A1 | 10/2002 | Lee et al. | |

OTHER PUBLICATIONS

"PCT Written Opinion of the International Searching Authority for PCT/US2011/034045", Dec. 19, 2011.

* cited by examiner

SYSTEM AND METHOD FOR THRUSTER PROTECTION DURING TRANSPORT

CROSS-REFERENCE TO RELATED APPLICATIONS

This application claims the benefit of U.S. Provisional Application No. 61/330,369 filed on May 2, 2010, which application is hereby incorporated by reference for all purposes in its entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to the transportation of semi-submersible drilling vessels, in particular those having fixed dynamic positioning thrusters.

2. Description of Related Art

Semi-submersible drilling vessels for conducting offshore drilling operations utilize buoyant pontoons, also known as lower hulls or floaters, which support a plurality of vertically extending columns or caissons, the upper portions of which carry a working platform. A plurality of thruster assemblies may be secured to the bottom of the pontoons for dynamically positioning the vessel at a fixed location in deep offshore waters, such as over a wellbore. Thruster assemblies are available from, for example, Wärtsilä Corporation of Helsinki, Finland and Rolls-Royce of London, England. A typical thruster assembly may cost $1.5 to $2 million, and eight (8) thruster assemblies may be attached to the pontoons of a single semi-submersible rig.

Semi-submersible rigs are typically transported in the ocean on self-propelled Heavy Transport Vessels (HTV), during what is known as a "dry tow," since he rig is on the deck of the HTV and out of the water. While the rig is positioned on the HTV, the thrusters are typically suspended over the side of the HTV and may be exposed to the slamming and dragging forces of the waves during transport. A wave slamming force may be caused by a wave hitting the surface of the thruster and causing an impact load. A wave dragging force may be caused by dragging the thruster in the water causing a relatively steady force on the thruster.

Rig owners and/or oil and gas operators do not want to risk damage to the thrusters during transport since the damage may render the rig unusable until the thrusters are repaired. The repairs usually take a significant amount of time. Semi-submersible rigs may rent for $500,000 per day, so the loss of operational time is costly. A replacement thruster may not be available for six (6) months. Suppliers may deny warranty claims due to the excessive forces and subsequent damage experienced during transport.

One proposed solution is to remove the thrusters and reinstall them after transport. However, this solution is costly since it may take at least fourteen (14) days of critical time to remove and reinstall the thrusters, resulting in the loss of millions of dollars in wasted rig down time. In addition, the thruster supplier usually charges significant additional fees for the removal and reinstallation of the thrusters.

Another proposed solution is to tow the semi-submersible vessel in the water with one or more tug boats, known as a "wet tow." The thrusters remain below sea level during a wet tow. However, this solution takes significantly more time than a dry tow because the semi-submersible rig has to be pulled at about one-half the speed used during a dry tow. Often the semi-submersible rig must be transported from one part of the world to another, so the loss in time and money is significant. The semi-submersible day rate is high compared to the HTV day rate. Moreover, during a wet tow, a thruster may be damaged if it impacts some obstruction below sea level.

Some semi-submersible rigs have thruster assemblies that are retractable. However, such rigs and retractable assemblies are expensive.

It would be desirable to protect the thruster assemblies during the transport of a semi-submersible vessel in a dry tow without removing the thruster assemblies.

BRIEF SUMMARY OF THE INVENTION

A system and method are provided for protecting a thruster assembly attached to a pontoon of a semi-submersible drilling vessel during dry tow transport. In one embodiment, a thruster cover support structure may be disposed with the pontoon of the semi-submersible vessel. The thruster cover support structure may be a frame positioned around the pontoon and made from any combination of steel tubulars, ropes, wires, chains, or other materials. A thruster cover may be disposed over the thruster assembly and removably secured with the frame. Alternatively, the thruster cover support structure may be a bracket, ring or flange attached with the pontoon. The thruster cover may be removably disposed with the bracket, ring or flange, such as by bolting or welding. In another embodiment, the thruster cover may be removably mounted directly to the pontoon, such as by welding.

In still another embodiment, a thruster cover may be disposed with the pontoon using tendons running through conduits positioned in the pontoons. A tendon attachment member may be positioned with the thruster cover if needed for attachment with one of the tendons. Alternatively, a thruster cover may be secured with the pontoon using a tendon disposed with the exterior of the thruster cover. In another alternative, a spacer barge may be positioned beneath the pontoons and between two thruster assemblies. The semi-submersible vessel may be supported and lifted with the spacer barge. The spacer barge with supported semi-submersible vessel may be positioned on the deck of the HTV. The thruster assemblies may be disposed above the elevation of the deck of the HTV. For some HTV designs, the semi-submersible vessel may be positioned so that the thruster assemblies are directly over the deck of the HTV.

The thruster cover may be a container having rigid solid or closed sides. In another embodiment, the thruster cover may have solid or closed sides that are flexible and not rigid, such as plastic. The thruster cover may also be a sheet or bag, such as made from a plastic. The thruster assembly enclosed in the thruster cover may be surrounded with a fluid for protection, such as water. In still other embodiments, the thruster cover may have partially solid or closed sides, such as a cage. The partially closed thruster cover may be rigid or flexible.

The novel system and method advantageously allow for the protection of the thruster assemblies during the transport of the semi-submersible vessel in a dry tow without removing the thruster assemblies.

BRIEF DESCRIPTION OF THE DRAWINGS

A better understanding of the embodiments may be obtained with the following detailed descriptions of the various disclosed embodiments in the drawings, which are given by way of illustration only, and thus are not limiting the invention, and wherein.

DETAILED DESCRIPTION OF THE INVENTION

Figure 1:
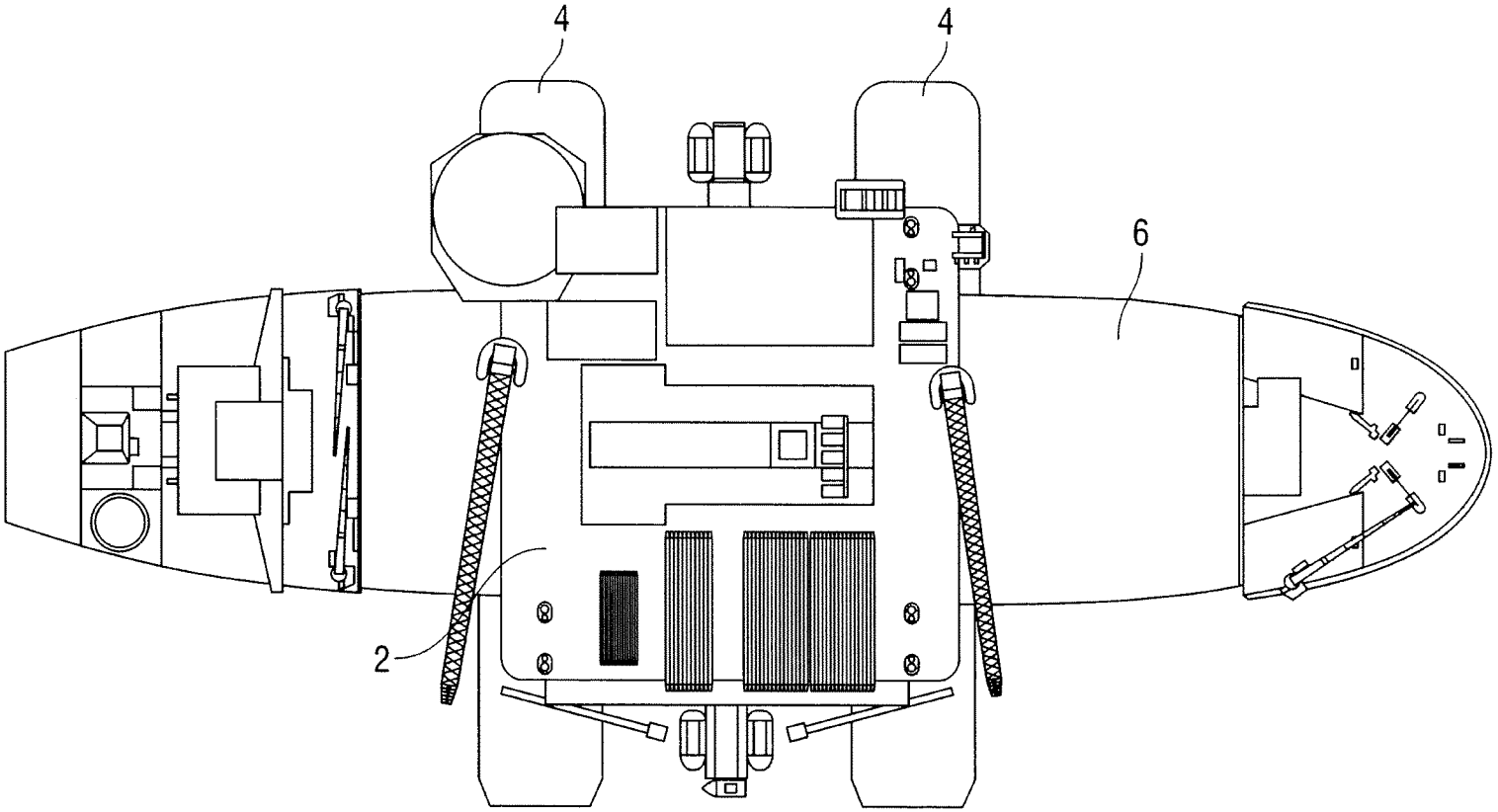
FIG. 1 is a plan view of a semi-submersible vessel disposed on the deck of an HTV for dry towing with the two pontoons extending over the side of the HTV.
Figure 2:
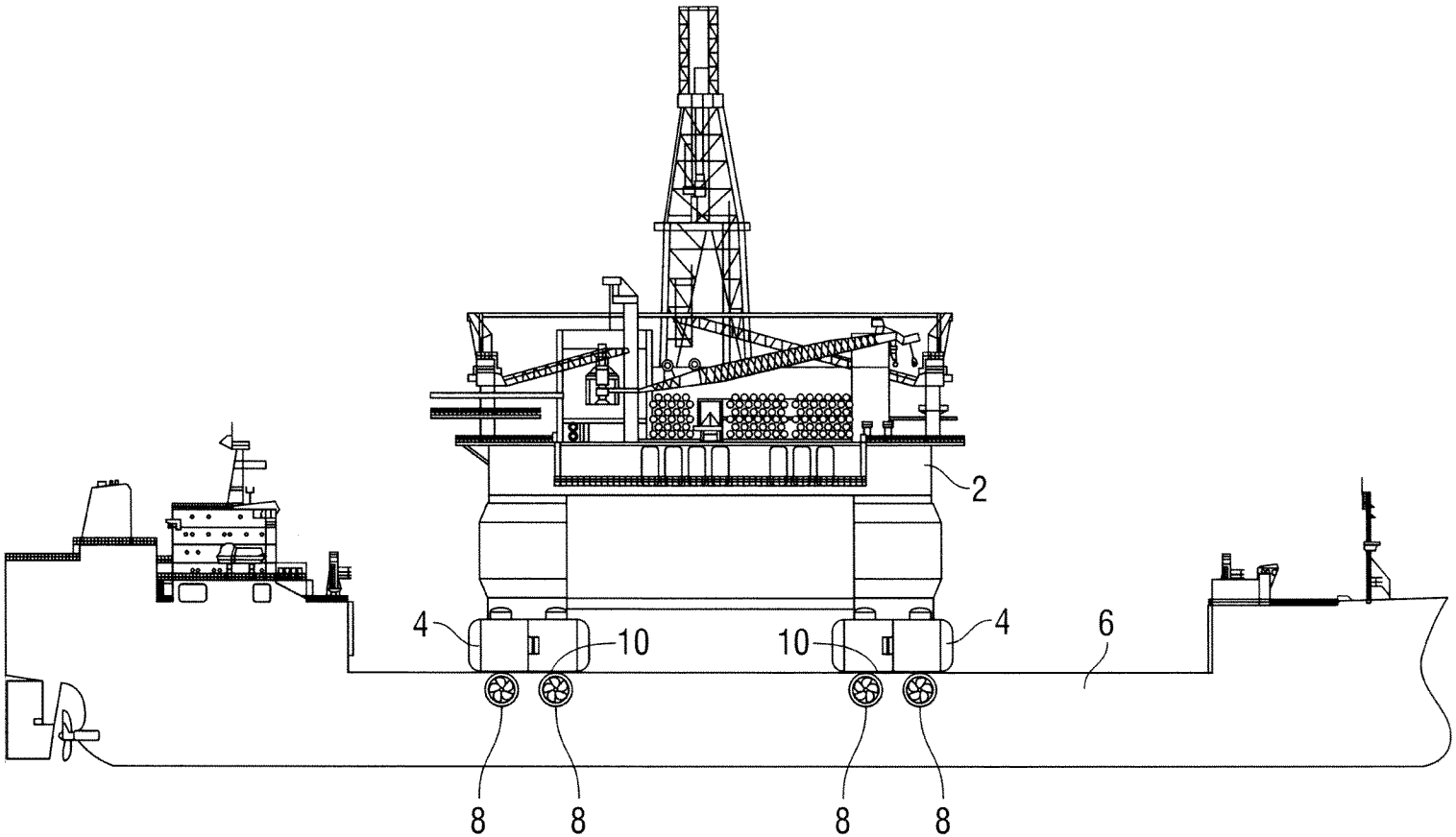
FIG. 2 is a side elevational view of FIG. 1 showing four thrusters disposed with the pontoons extending over one side of the HTV.
Figure 3:
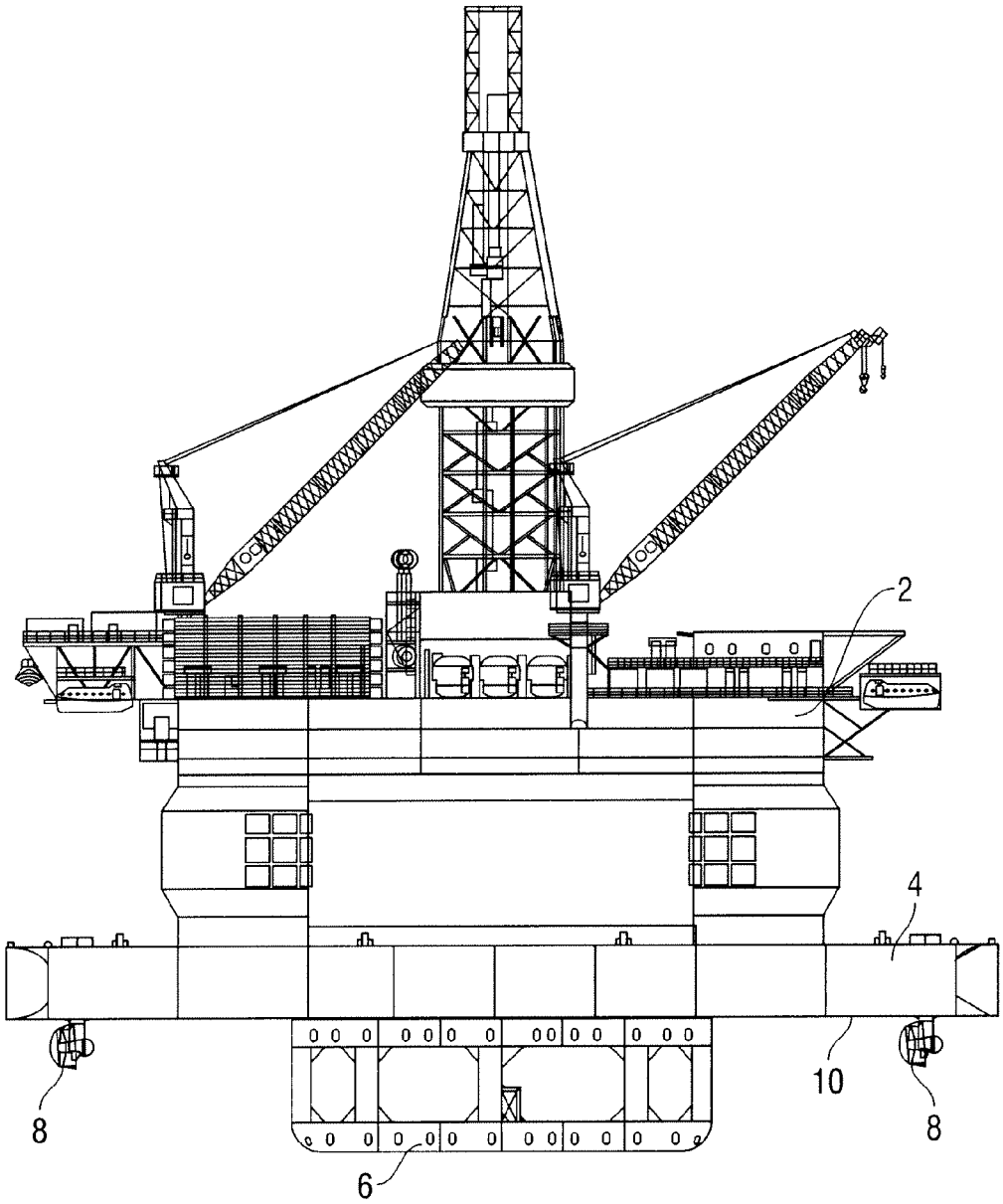
FIG. 3 is a cross-sectional view of the HTV of FIG. 1 showing a front elevational view of the semi-submersible vessel with a pontoon and two thrusters extending over the side of the HTV.
Figure 4:
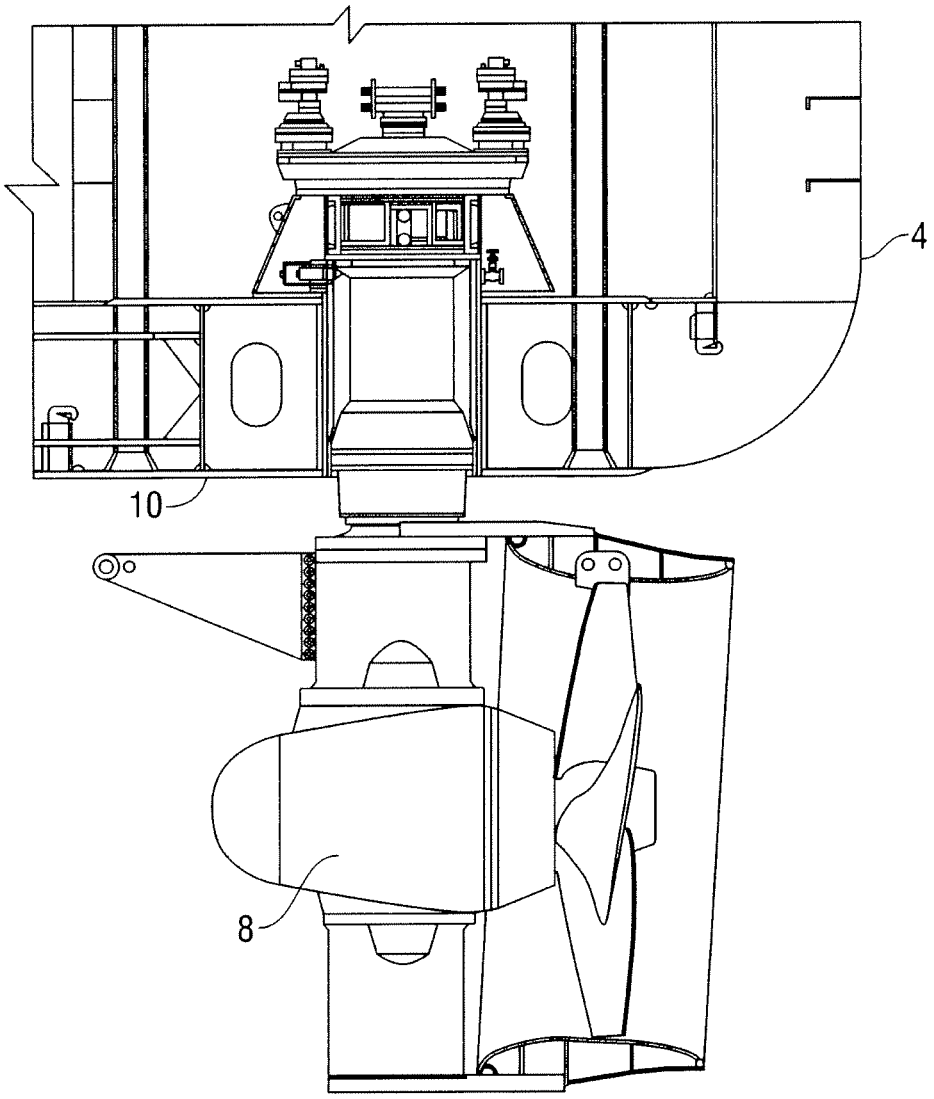
FIG. 4 (Prior Art)
FIG. 4 is an elevational detail view of a thruster assembly.

In FIG. 1, a semi-submersible vessel 2 is disposed on the deck of an HTV 6 for dry towing. Two pontoons 4 used to float the semi-submersible vessel 2 when it is in the water extend over both sides of the HTV 6. In FIG. 2, four thruster assemblies 8 attached with bottom surfaces 10 of the pontoons 4 extend over the side of the HTV 6 and may be exposed to wave forces during transport. In FIG. 3, two thruster assemblies 8 disposed with the bottom surface 10 of pontoon 4 are exposed to wave forces during transport. In FIG. 4, thruster assembly 8 is disposed with pontoon bottom surface 10.

Thruster Cover

Figure 5A:
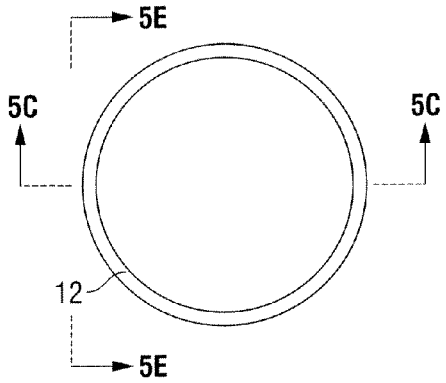
FIG. 5A is a section view along line 5A-5A of the thruster cover of FIG. 5C.
Figure 5B:
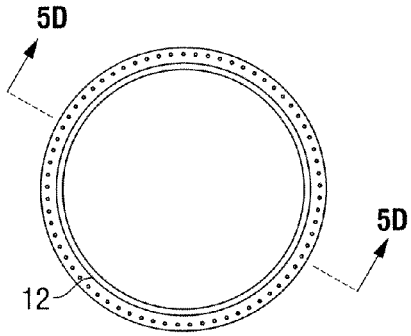
FIG. 5B is a top view along line 5B-5B of the thruster cover of FIG. 5C.
Figure 5C:
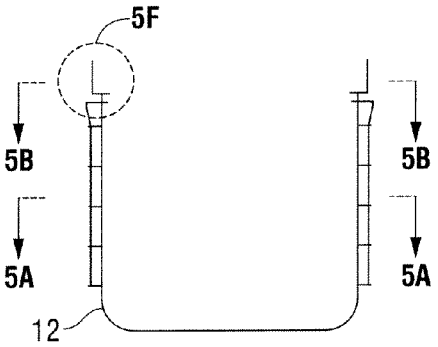
FIG. 5C is a section view along line 5C-5C of the thruster cover of FIG. 5A.
Figure 5D:
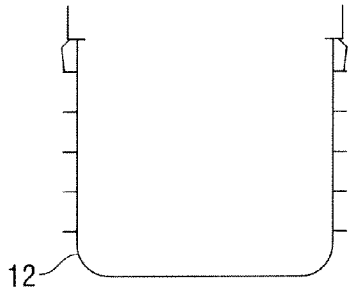
FIG. 5D is a section view along line 5D-5D of the thruster cover of FIG. 5B.
Figure 5E:
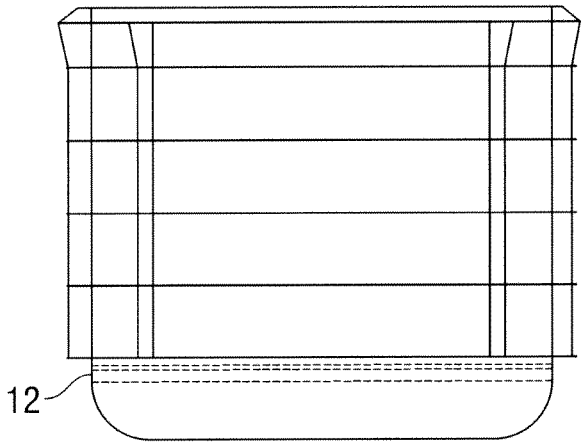
FIG. 5E is an elevational view along line 5E-5E of the thruster cover of FIG. 5A.
Figure 5F:
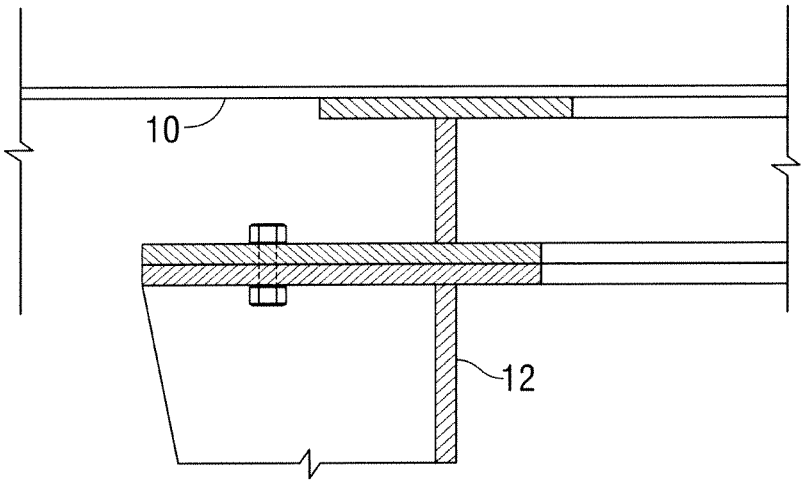
FIG. 5F is a detail view of detail area 5F in FIG. 5C of the connection of the thruster cover with the bottom surface of a pontoon.
Figure 5H:
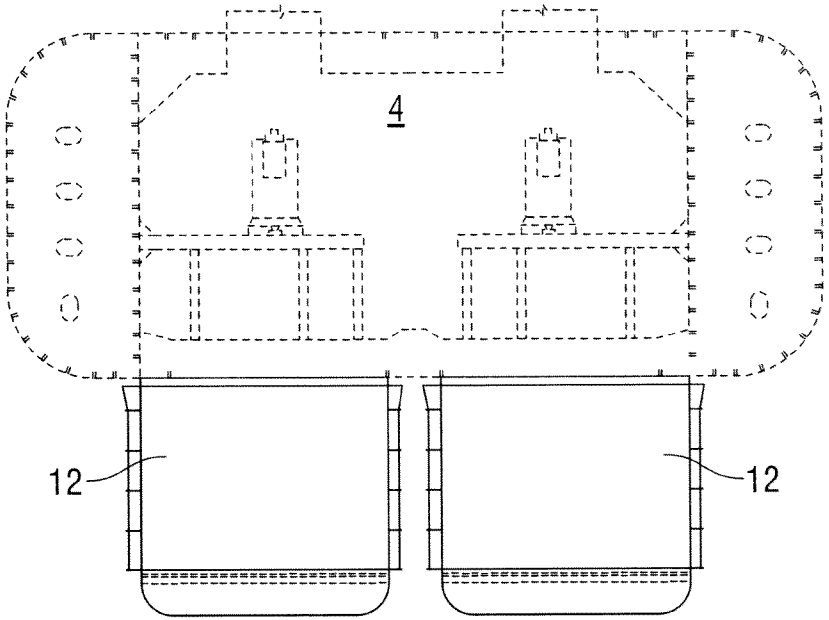
FIG. 5H is an elevational section view along line 5H-5H of FIG. 5G of the two thruster covers attached to a pontoon.
Figure 5G:
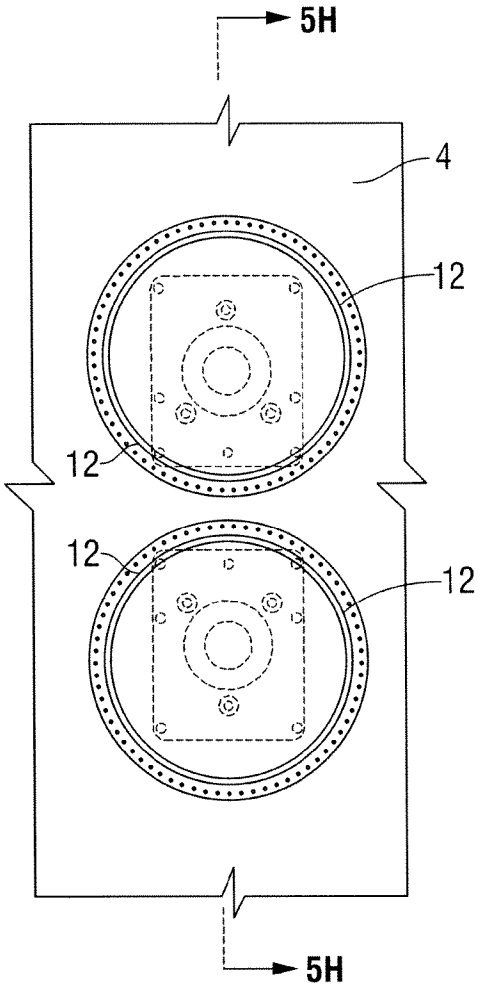
FIG. 5G is a bottom view of two thruster covers attached to a pontoon.

A thruster cover or container may be used to protect thruster assemblies 8 attached to pontoons 4 during transport. In FIGS. 5A-5E a rigid solid or closed thruster cover 2 is shown for positioning over a thruster assembly 8 (not shown). Other shapes, sizes, dimensions, and designs of thruster covers are contemplated. The thruster cover 12 may be made of a durable material such as steel, although other materials are contemplated. In FIG. 5F, the thruster cover 12 is attached to the bottom surface 10 of pontoon 4 by welding. However, as will be discussed in detail below, other attachment means are contemplated. In FIGS. 5G-5H, two thruster covers 12 are attached to the pontoon 4.

Figure 7A:
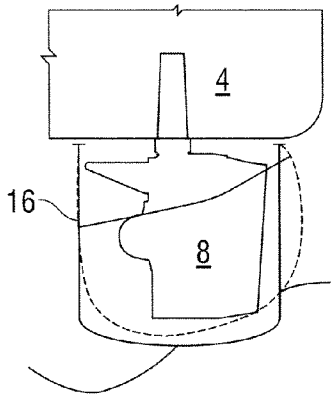
FIG. 7A is a schematic detail view of a flexible solid or closed thruster cover disposed over a thruster assembly with a pontoon bottom surface with a fluid surrounding the thruster assembly.
Figure 6:
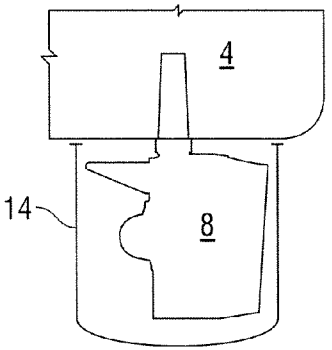
FIG. 6 is a schematic elevational view of a rigid solid or closed thruster cover positioned over a thruster assembly disposed with a pontoon bottom surface.
Figure 7:
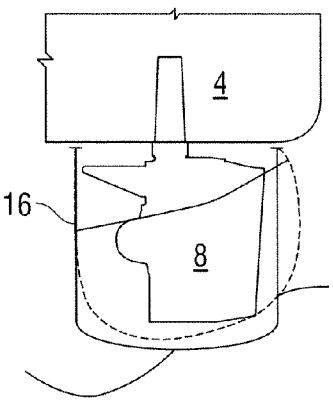
FIG. 7 is a schematic elevational view of a flexible solid or closed thruster cover disposed over a thruster assembly with a pontoon bottom surface with a fluid surrounding the thruster assembly.

In FIG. 6, a rigid solid or closed thruster cover 14 is disposed over thruster assembly 8. The thruster cover 14 may be made of a durable material such as steel, although other materials are contemplated, including plastic. The forces of the waves may be induced into the cover 14 and transferred to the pontoon 4. In FIGS. 7-7A, a flexible solid or closed thruster cover 16 is disposed over thruster assembly 8. The thruster cover 16 may be made of thin plastic, such as a bag or sheet, although other materials are contemplated. The cover 16 may contain a fluid such as water to surround the thruster assembly 8. Standard water bags are available from, for example, Water Weights Ltd. of Aberdeen, UK. A wide range of sizes of water weights proof load bags are available. The bags are suited for inaccessible lifting points. The wave slamming forces may be absorbed by the cover 16 and enclosed fluid.

Figure 8:
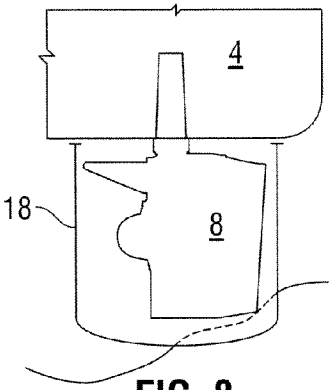
FIG. 8 is a schematic elevational view of a rigid partially closed thruster cover disposed over a thruster assembly with a pontoon bottom surface.
Figure 9:
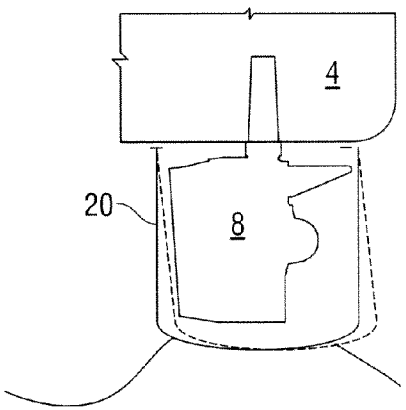
FIG. 9 is a schematic elevational view of a flexible partially closed thruster cover disposed over a thruster assembly with a pontoon bottom surface.

In FIG. 8, a rigid partially closed thruster cover 18, such as a cage, is disposed over thruster assembly 8. The thruster cover 18 may be made of a durable material such as steel, although other materials are contemplated. The forces of the waves will be dispersed, lowering the forces on the cover 18 and the pontoon 4. In FIG. 9, a rigid partially closed thruster cover 20, such as a cage, is disposed over thruster assembly 8. The thruster cover 20 may be made of plastic, although other synthetic materials are contemplated. The forces of the waves will be dispersed, lowering the forces on the cover and the pontoon. Also, deformation of the cover 20 may result in lower forces transferred to the pontoon 4 due to elastic deformation. Other types, shapes, and sizes of thruster covers are contemplated. As can now be understood, partially closed thruster covers may also be partially open thruster covers.

Figure 9B:
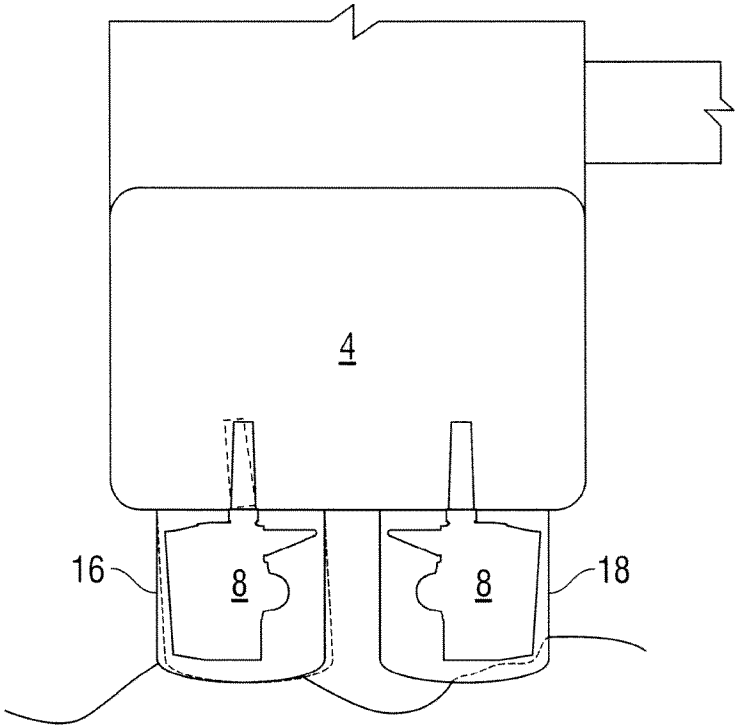
FIG. 9B is a schematic front view of two thruster assemblies disposed with a pontoon, with one thruster assembly covered with a closed and flexible thruster cover and one thruster assembly covered with a partially closed thruster cover.
Figure 9A:
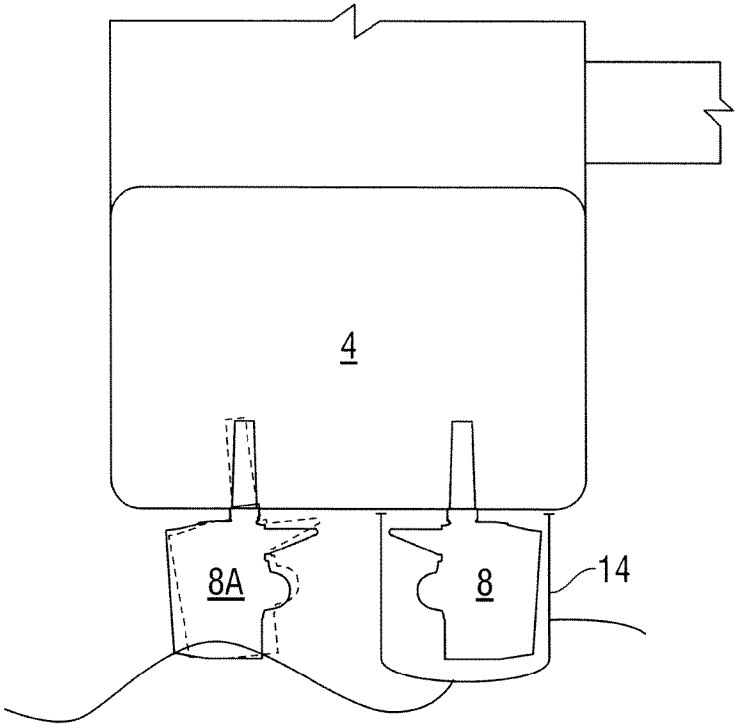
FIG. 9A is a schematic front view of two thruster assemblies disposed with a pontoon, with one thruster assembly uncovered and one thruster assembly covered with a closed and rigid thruster cover.

In FIG. 9A, two thruster assemblies (8, 8A) are disposed with a pontoon 4, with one thruster assembly 8A uncovered and one thruster assembly 8 covered with a closed and rigid thruster cover 14. In FIG. 9B, two thruster assemblies 8 are disposed with a pontoon 4, with one thruster assembly 8 covered with a closed and flexible thruster cover 16 and one thruster assembly 8 covered with a partially closed thruster cover 18. It is contemplated that any thruster cover shown in any of the Figures may be used in combination with a different thruster cover on a pontoon 4.

Any thruster cover shown in any of the Figures may be used with any embodiment shown in any of the Figures. Any of the thruster covers are containers for protecting or enclosing the thruster assembly. As can now be understood, the thruster cover may absorb, deflect and/or break the slamming and/or dragging wave forces or possible obstacles in the ocean. Depending on the type and size of the force as compared with the strength of the thruster 8, the thruster cover may be fully closed, partially closed, stiff, or flexible. For example, for slamming forces only, the embodiment in FIG. 7 may be sufficient. For dragging forces, a closed stiff solution may be desirable, like the embodiment in FIG. 6, or a partially open solution may be desirable, like the embodiments in FIGS. 8-9, to break the waves.

The thruster covers may be hoisted into place over the thruster assemblies using Strand Jacks, which are available from, for example, John Gibson Group, Ltd. of Middlesbrough, UK. It is also contemplated that the thruster covers may be floated below the thruster assemblies prior to covering the thruster assemblies. If two thruster assemblies are disposed adjacent each other, it is contemplated that the two thruster covers may be attached with each other prior to placement in the water for floating.

Securing the Thruster Cover

Figure 11:
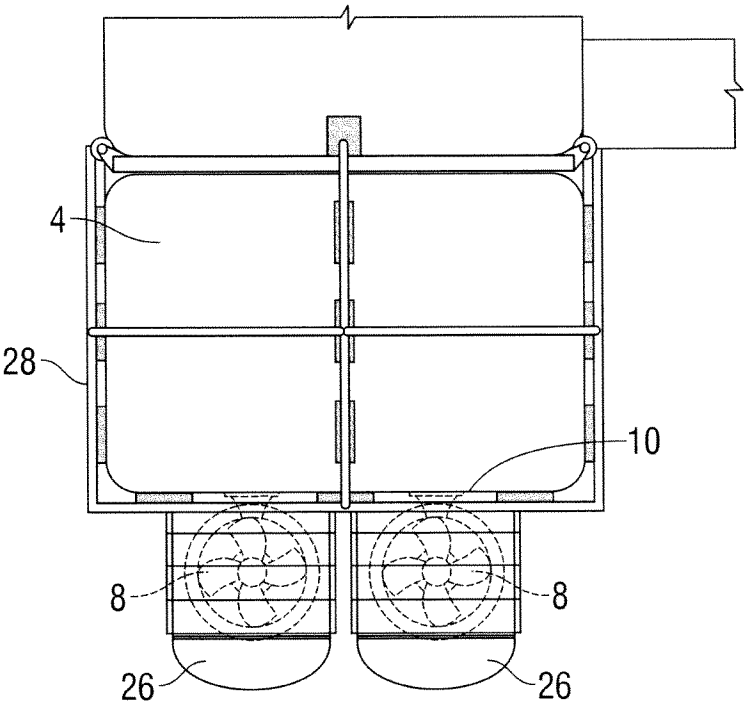
FIG. 11 is a front elevational view of FIG. 10.
Figure 10:
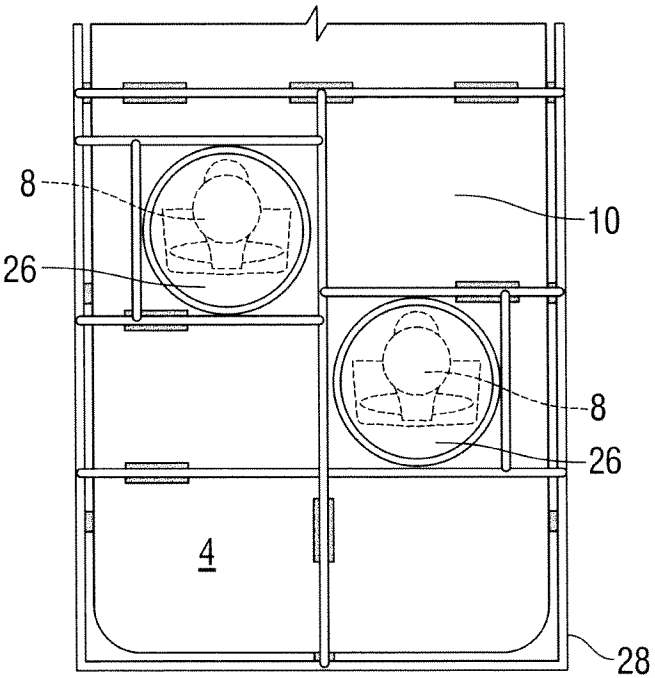
FIG. 10 is a bottom partial view of a thruster cover support structure disposed with a pontoon, and two thruster covers disposed over two thruster assemblies shown in phantom and positioned with the thruster cover support structure.

As shown in FIG. 5F, the thruster cover may be attached directly with the bottom surface 10 of the pontoon 4, such as by welding. However, welding to the pontoon 4 may not be acceptable to the rig owner or the operator. In FIGS. 10-11, thruster cover support structure 28 is disposed with pontoon 4 to provide a structure to support thruster covers 26 shown disposed over thruster assemblies 8. It is contemplated that support structure 28 may be wrapped around the pontoon 4, and not fixedly attached with pontoon 4. It is also alternatively contemplated that the support structure 28 may be fixedly attached with pontoon 4. Thruster covers 26 may be removably attached with support structure 28. Thruster cover 26 may be any of the thruster cover embodiments shown in any of the Figures. The support structure 28 shown is a frame, which may be made from steel, such as bars or tubulars. However, other materials, shapes and sizes are contemplated. It is contemplated that support structure 28 may be made from rope, chain, or wires, or from any combination thereof. It is contemplated that support structure 28 may be a net.

Figure 12:
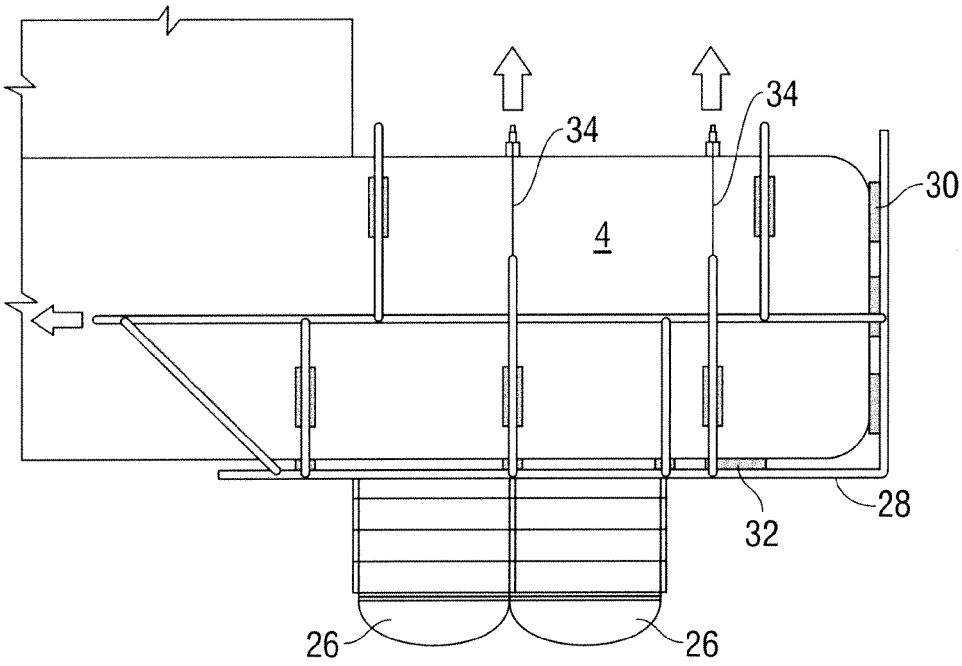
FIG. 12 is an elevational view of a thruster cover support structure or frame with thruster covers attached using chain tension and pad compression.
Figure 13:
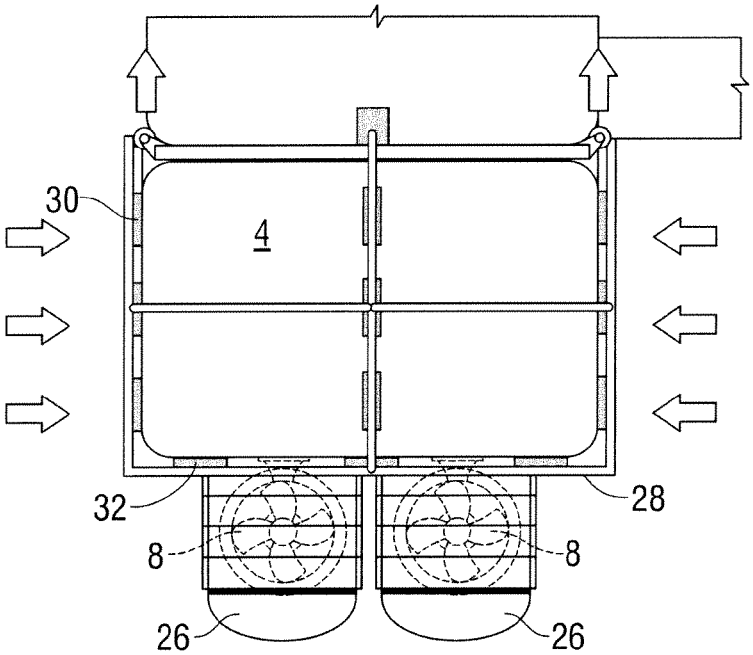
FIG. 13 is a front view of FIG. 12.
Figure 14:
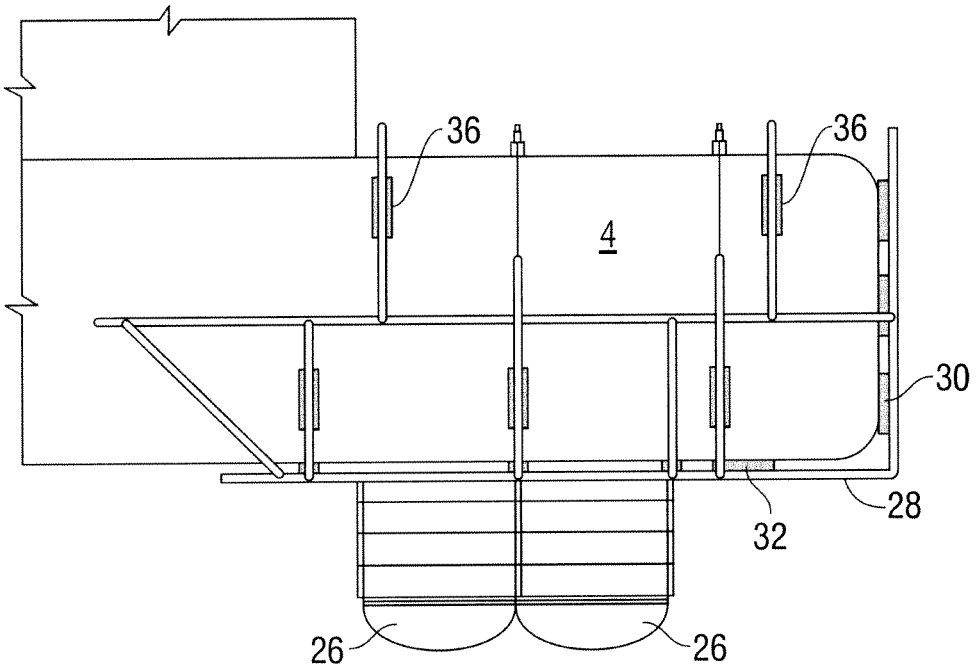
FIG. 14 is a detail view of the vertical stanchions and variable length pads in a thruster cover support frame.
Figure 15:
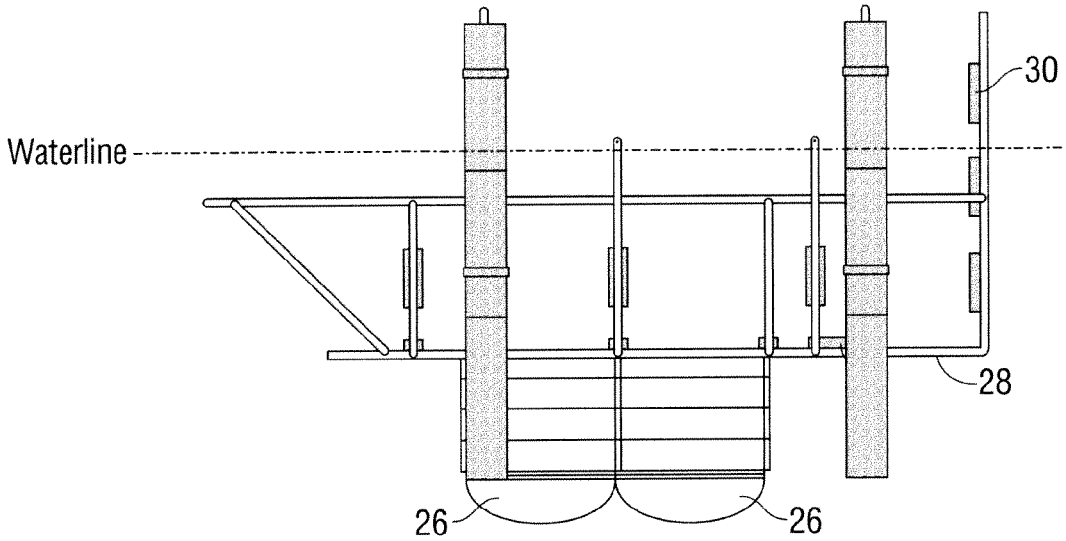
FIG. 15 is an elevational view of a thruster cover support frame with thruster covers attached floating.
Figure 15A:
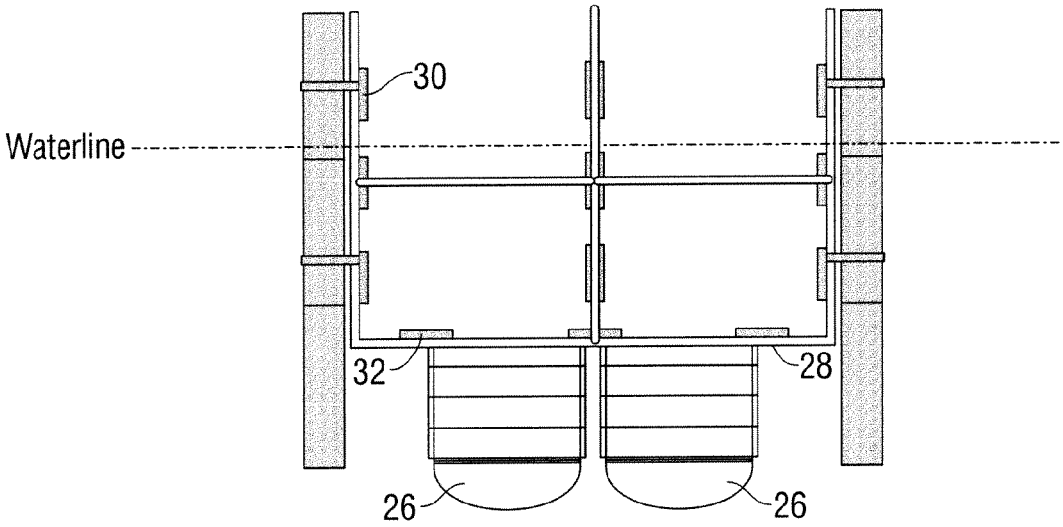
FIG. 15A is a front view of FIG. 15.
Figure 16:
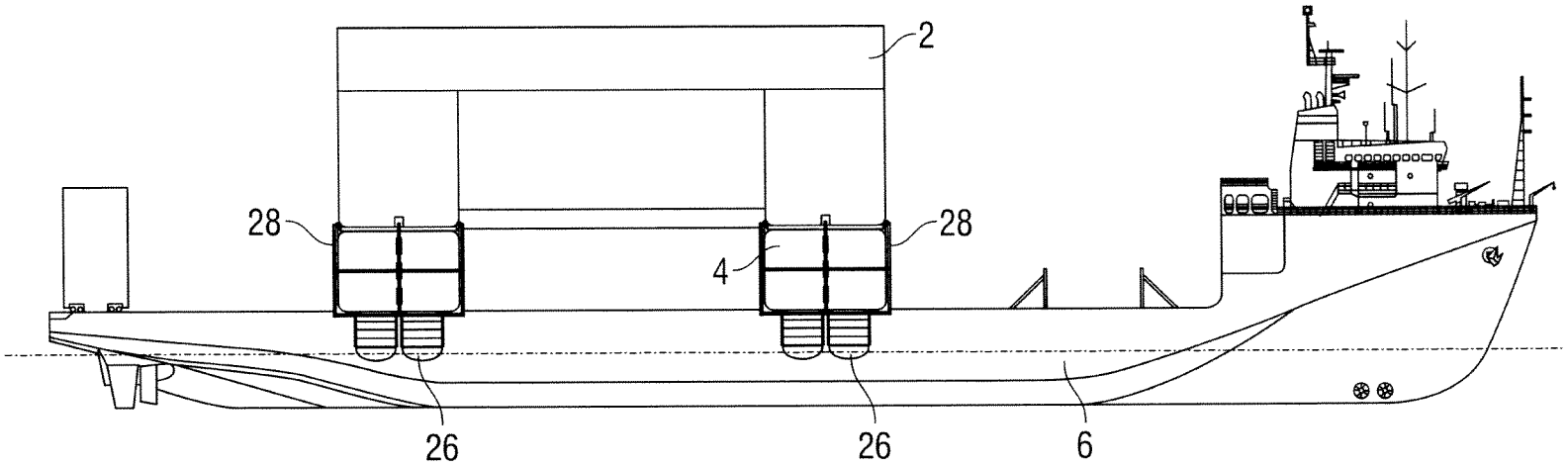
FIG. 16 is an elevational view of two thruster cover support structures disposed with two pontoons of a semi-submersible vessel during a dry tow on an HTV.

In FIGS. 12-13, one embodiment of attachment of the support frame 28 is shown using chain 34 tension and pad (30, 32) compression. Other attachment means are contemplated. The pads (30, 32) are positioned between the support structure 28 and the pontoon 4 and may be adjustable. In FIG. 14, vertical stanchions 36 disposed in support structure 28 may be adjusted, such as longitudinally. The pads (30, 32) may be positioned along the length of the stanchions 36. Turning to FIGS. 15-15A, thruster cover support frame 28 with thruster covers 26 and pads (30, 32) attached may be floated as a single unit prior to installation. Other attachment methods are contemplated. As shown in FIGS. 15-15A, it is contemplated that support structure 28 may be installed without lifting. FIG. 16 shows two thruster cover support structures 28 disposed with two pontoons 4 of semi-submersible vessel 2 during transport on a HTV 6. The four thruster covers 26 protect the covered thruster assemblies 8.

The embodiments shown in FIGS. 12-16 advantageously allow for thruster cover attachment without any contact with the thruster assembly 8 during the installation and removal of the cover 26 and during the transport. Attachment to the hull or pontoon 4 may be made without welding. It is contemplated that dual redundant connection may be made. The wave loading may be transferred to the pontoon 4 at the support structure 28 or bulkheads. It is contemplated that installation may be achieved with tug boat assistance only. The embodiment advantageously allows for simultaneous installation of all thruster covers 26 with a pontoon 4 to shorten installation and removal time. It is contemplated that the support structure 28 and covers 26 may be self-floating. It is contemplated that no lifting for installation from the water may be required.

Figure 17:
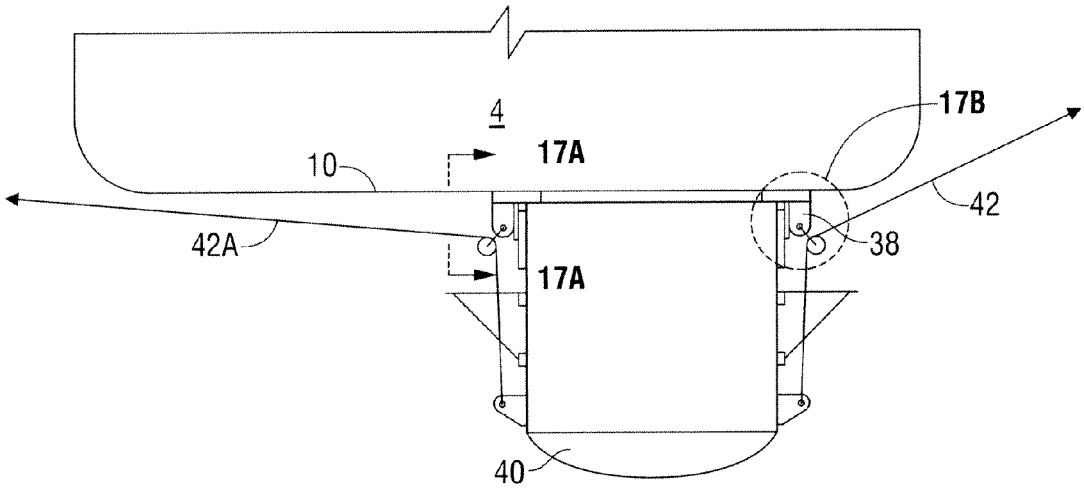
FIG. 17 is an elevational view of a thruster cover support structure or member attached with the bottom surface of a pontoon.
Figure 17A:
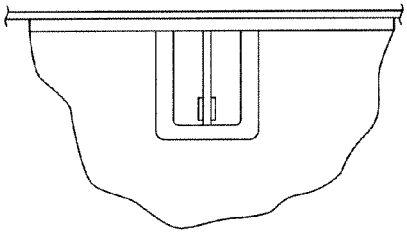
FIG. 17A is a detail view along line 17A-17A of FIG. 17.
Figure 17B:
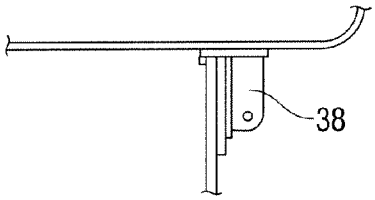
FIG. 17B is a detail view of detail area 17B of FIG. 17.

Turning to FIGS. 17-17B, thruster cover support structure or member 38 is attached with the bottom surface 10 of pontoon 4. Thruster cover 40 is positioned over a thruster assembly (not shown) and disposed with support structure 38. Support structure 38 may be welded to pontoon 4, although other attachment means are contemplated. Support structure 38 is shown as a bracket. However, other types, shapes, dimensions, and sizes of support structures are contemplated for the purpose of supporting thruster cover 40. Thruster cover 40 may be removably attached with support structure 38, such as by welding or bolting. It is also contemplated that one or more tendons (42, 42A) may be used to lift cover 40 and/or hold cover 40 in position over a thruster assembly.

Figure 18:
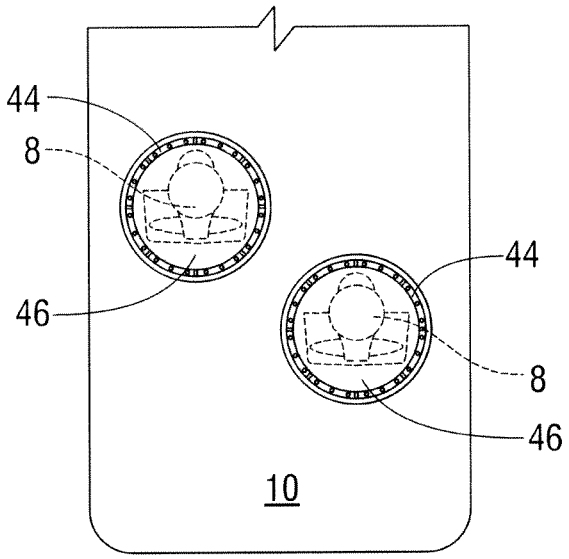
FIG. 18 is a bottom view of two thruster cover support structures or members attached with the bottom surface of a pontoon, with thruster covers disposed with support members over thruster assemblies shown in phantom.
Figure 18A:
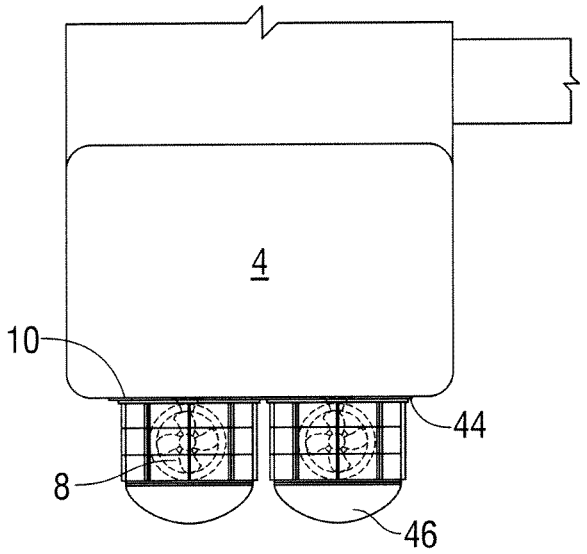
FIG. 18A is a front view of FIG. 18.
Figure 18B:
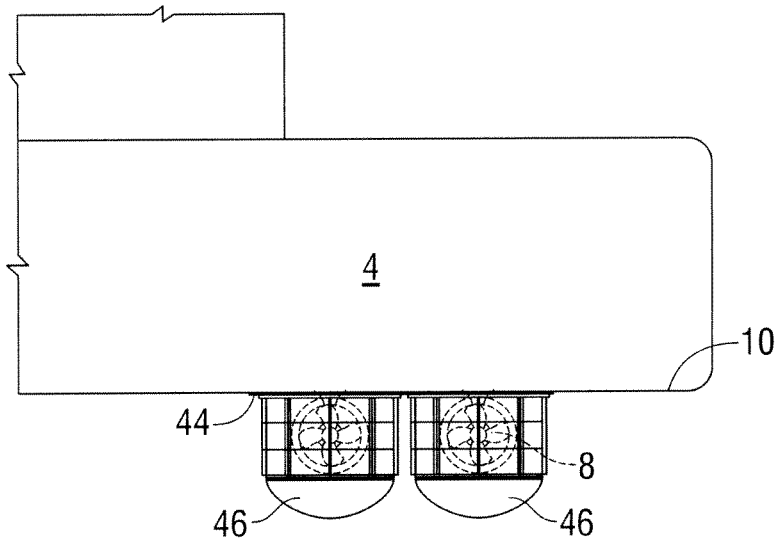
FIG. 18B is an elevational view of FIG. 18.

In FIGS. 18-18B, two thruster cover support structures or members 44 are attached with the bottom surface 10 of pontoon 4. Two thruster covers 46 are positioned over thruster assemblies 8 and disposed with support structures 44. Support structures 44 may be welded to pontoon 4, although other attachment means are contemplated. Support structures 44 are shown as rings or flanges. However, other types, shapes, dimensions, and sizes of support structures are contemplated for the purpose of supporting thruster covers 46. Thruster covers 46 may be removably attached with support structures 44, such as by welding or bolting. It is contemplated that support structure 44 may be either internal or external to the hull or pontoon 4. It is contemplated that any of the thruster cover support structures shown in any of the Figures, including brackets, rings, flanges, and frames, may have lifting lugs integrated with them for use in lifting the thruster covers.

Figure 19:
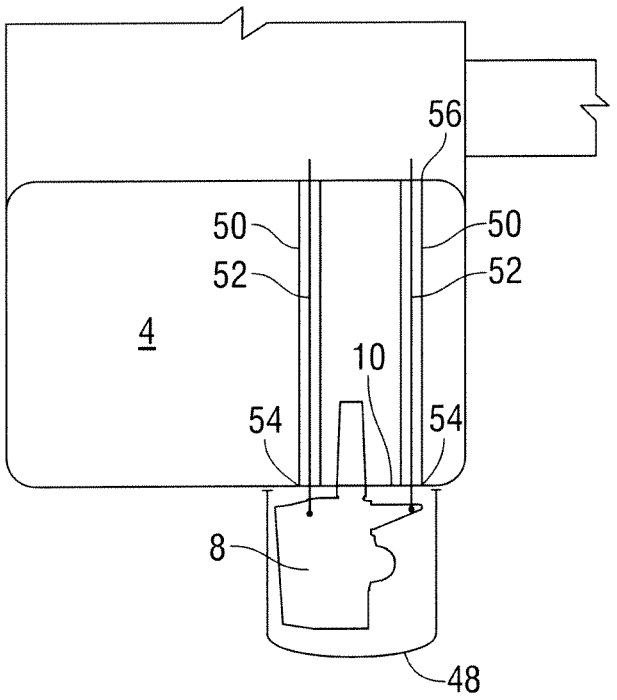
FIG. 19 is an elevational schematic view of a thruster cover secured with tendons over a thruster assembly against a pontoon.

Turning to FIG. 19, a thruster cover 48 is held with tendons 52 over thruster assembly 8 against pontoon 4. Tendons 52 may be wires, chains, ropes, or some other device for withstanding tension forces. There are typically three openings 54 in the pontoon 4 bottom surface 10 spaced around the thruster assembly 8. There are also typically three conduits or tubes 50 in the pontoon 4 extending from the top surface openings 56 of the pontoon 4 to the bottom surface 10 for installation or removal of the thruster assembly 8. It is contemplated that tendons 52 may be run through the conduits or tubes 50 for attachment with the cover 48. The tendons 52 may be tensioned by a device on or in the pontoon 4 or the HTV 6 or the semi-submersible vessel 2. Advantageously, no welding to the pontoon 4 is required.

Figure 20A:
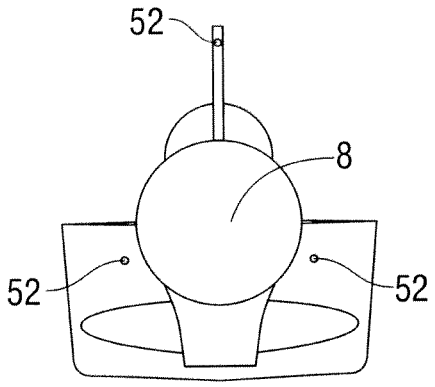
FIG. 20A is a top schematic view of a thruster assembly shown in the position in which it is installed with and removed from a pontoon.
Figure 20B:
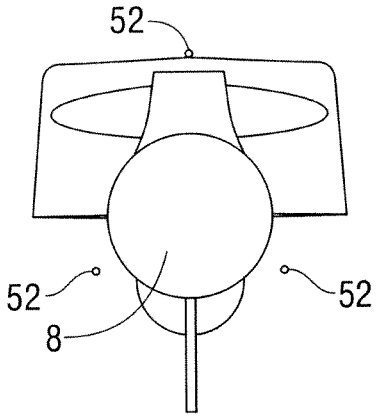
FIG. 20B is a top schematic view of a thruster assembly shown in the position in which it may be transported during a dry tow.
Figure 20C:
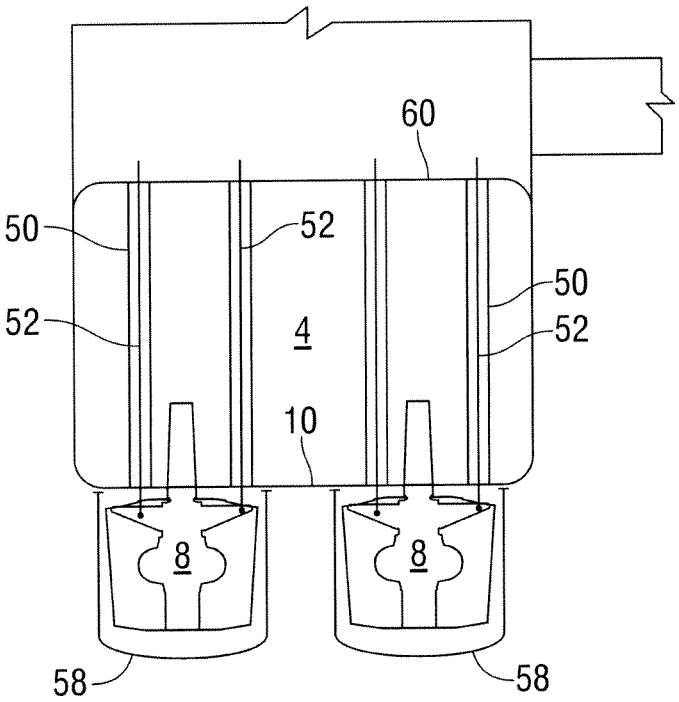
FIG. 20C is a front schematic view of two thruster covers disposed over two thruster assemblies and held in position with tendons.

In FIG. 20A, a thruster assembly 8 is shown in the position in which it is installed with and removed from the pontoon 4. Three tendons 52 may be attached with the thruster assembly 8 during such operations. As shown in FIG. 20B, during dry tow transport, the thruster assembly 8 may be rotated 180° about a vertical axis from the position shown in FIG. 20A to provide for tendon 52 clearance for attachment with the thruster cover (not shown). In FIG. 20C, the thruster covers 58 are disposed against the pontoon 4 with tension from the tendons 52 pulled through tubes 50. It is also contemplated that there may be no conduits or tubes 50, but just openings in the top surface 60 and the bottom surface 10 of the pontoon 4 for the tendons 52. It is also contemplated that there may be no openings in the top surface 60 of the pontoon 4, and that the tendons 52 may be tensioned within the pontoon 4. For installation, the thruster covers 58 may be floated below the thruster assemblies 8, then hoisted up while being guided with the tendons 52. Alternatively, it is contemplated that the thruster covers 58 may be pulled up with the tendons 52. Other attachment methods are contemplated.

Figure 21A:
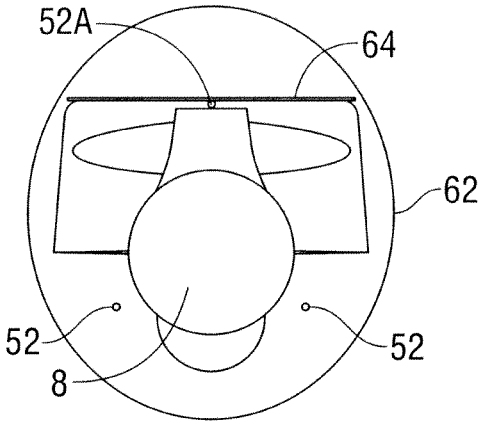
FIG. 21A is a top schematic view of a thruster assembly shown in the position in which it may be transported during a dry tow, with one tendon disposed with a tendon attachment member, and two tendons disposed with a thruster cover.

In FIG. 21A, tendon 52A is disposed with a tendon attachment member 64, and two tendons 52 are disposed with the thruster cover 62. The tendon attachment member 64 is disposed with the thruster cover 62, such as by welding. However, other attachment means are contemplated. The attachment member 64 may be a rod or tubular, such as made from steel. However, other types and materials are contemplated. As can now be understood, the tendon attachment member 64 may provide a support point for tendon 52A should clearance between the thruster assembly 8 and the thruster cover 62 be limited. It is contemplated that more than one tendon attachment member 64 may be used. It is also contemplated that the thruster covers may be of sufficient size to insure there is no clearance issue with tendons (52, 52A).

Figure 21B:
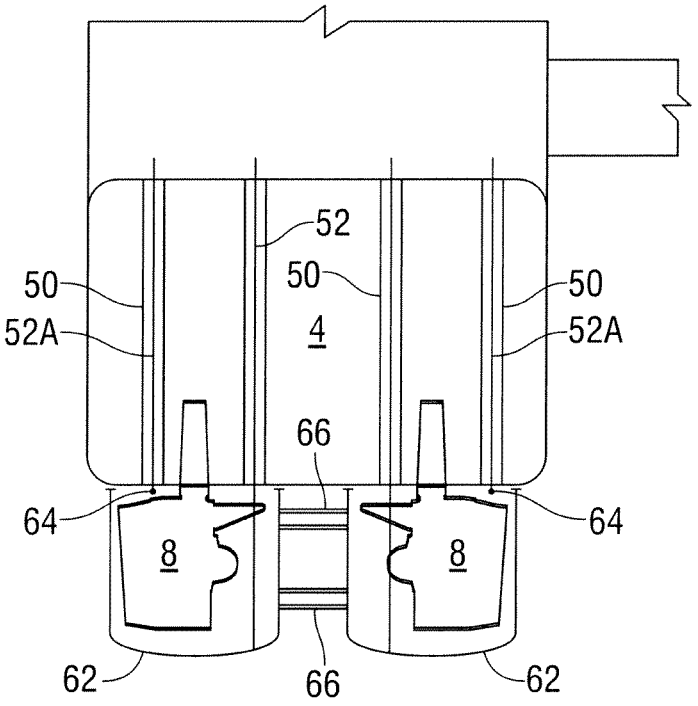
FIG. 21B is a front schematic view of two thruster covers disposed with a pontoon with tendons, two of which tendons are attached with tendon attachment members positioned in covers.
Figure 22:
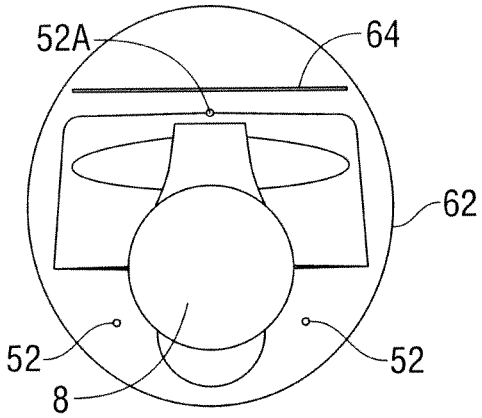
FIG. 22 is a top schematic view of a thruster cover shown in the position during installation when there is a tendon attachment member.

In FIG. 21B, two thruster covers 62 are disposed with the pontoon 4 with the tendons (52, 52A). The two tendons 52A are attached with two tendon attachment members 64 positioned in the covers 62. It is also contemplated that only two tubes 50 with two tendons (52, 52A) may be used for each cover 62, rather than three tubes. In such embodiment, it is contemplated that the two covers 62 may be attached together for stability, such as with the cover attachment members 66. The cover attachment members 66 may be steel rods or tubulars, although other types and materials are contemplated. The use of only two conduits or tubes 50 for installation of each cover 62 minimizes any clearance issue with the tendons 52. It is contemplated that here one tendon (52, 52A) in a conduit 50 is shown, there may be more than one tendon in a single conduit 50. In FIG. 22, the thruster cover 62 is shown in the position during installation when there is a tendon attachment member 64.

In one embodiment of a method of loading the semi-submersible rig 2 on the deck of the HTV 6, a cribbing may be installed on the deck and the rig 2 floated on it. The rig 2 will de-ballast and the thrusters 8 will surface. Each of the thrusters 8 may have three (3) conduits or tubes 50 for installation and removal purposes. Flanges or rings 44 for bolts may be fixedly attached with the pontoon 4 around the thrusters 8. Protective paint may be applied. Two of the thruster covers may be attached together for ease of installation. The thruster covers may be moved into the water and floated underneath the thrusters 8. The thrusters 8 may be rotated to create clearance between the thruster covers and the thruster assemblies 8. The tendons 52 may be attached with the thruster covers. The covers may be hoisted into position with Stand Jacks and guided with the tendons 52. Alternatively, or in addition, the covers may be pulled up with the tendons 52. The tendons 52 may also be used to control the position of the thruster covers during installation. The covers may be bolted or otherwise removably attached with the flanges or rings 44. Installation may be simultaneous on several corners with several thruster covers and with sea fastening.

Figure 23:
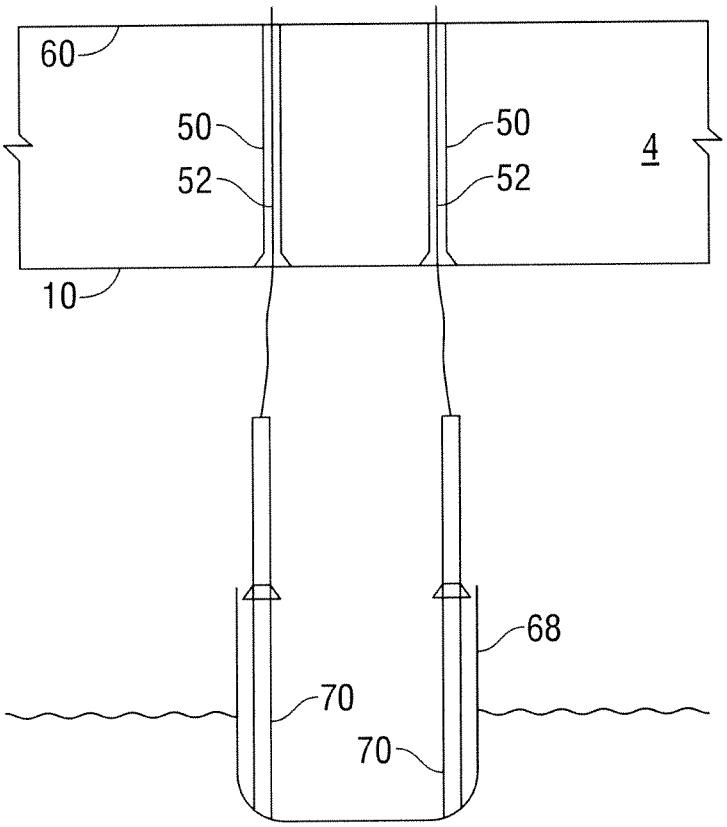
FIG. 23 is an elevational schematic view of two thruster cover guides disposed with a thruster cover, with tendons disposed through a pontoon and positioned with the guides.

Turning to FIG. 23, two thruster cover guides 70 are disposed with the thruster cover 68. The tendons 52 are disposed through the pontoon 4 and positioned with the guides 70. The guides 70 may be a tubular, such as made from steel. However, other types and materials are contemplated. The guides 70 may be fixedly attached with the cover 68. It is also contemplated that the tendons 52 may extend through the guides 70 and attach with the cover 68. The tendons 52 may be used to secure the cover 68 against the pontoon 4 around a thruster assembly (not shown) for transport. It is contemplated that there may be one or more guides 70.

Figure 24:
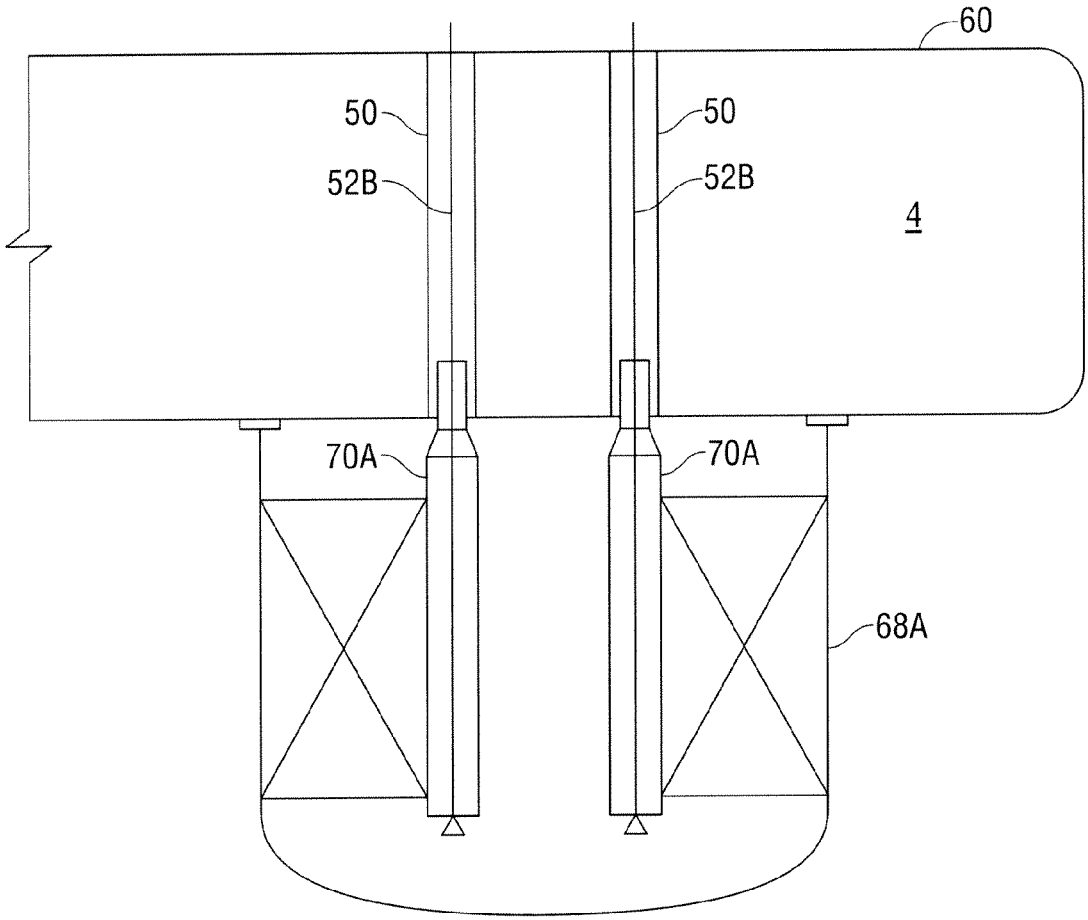
FIG. 24 is an elevational schematic view of two thruster cover guides disposed with a thruster cover, with tendons disposed through a pontoon and positioned through the guides, and the thruster cover disposed with the pontoon.

In FIG. 24, two thruster cover guides 70A are disposed with the thruster cover 68A. The tendons 52B are disposed through the pontoon 4 and extend through the guides 70A and attach with the cover 68A. The guides 70A may be a tubular, such as made from a durable material such as steel. However, other types and materials are contemplated. The guides 70A may be fixedly attached with the cover 68A. The tendons 52B may be used to secure the cover 68A up against the pontoon 4 around a thruster assembly (not shown) for transport. It is contemplated that there may be one or more guides 70A.

Figure 25:
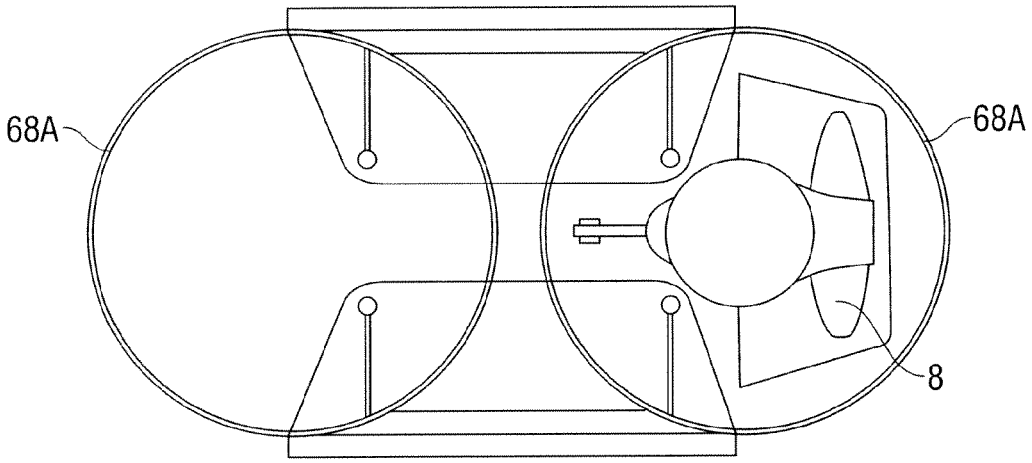
FIG. 25 is a plan view of two thruster covers disposed with each other.
Figure 25A:
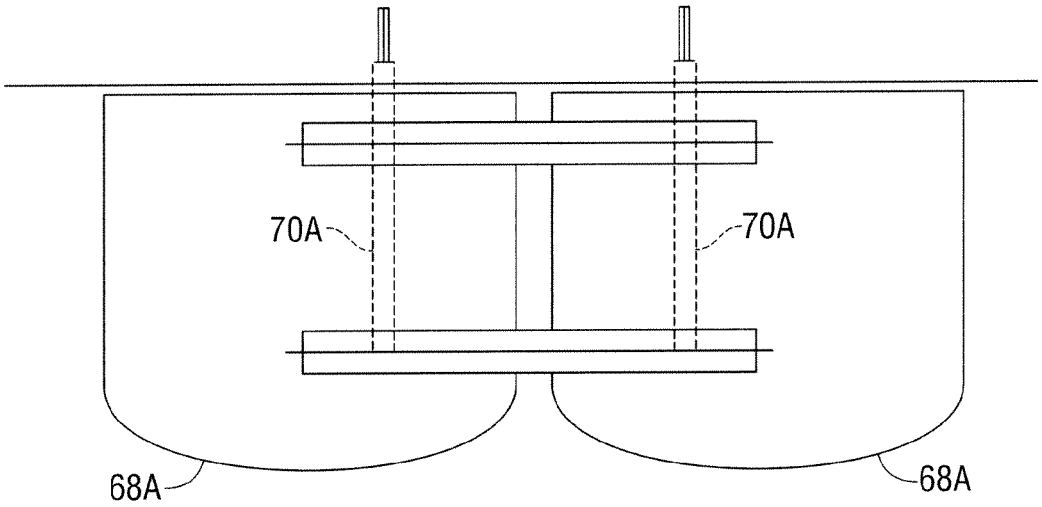
FIG. 25A is an elevational view of FIG. 25 showing thruster cover guides disposed with the thruster covers.
Figure 25B:
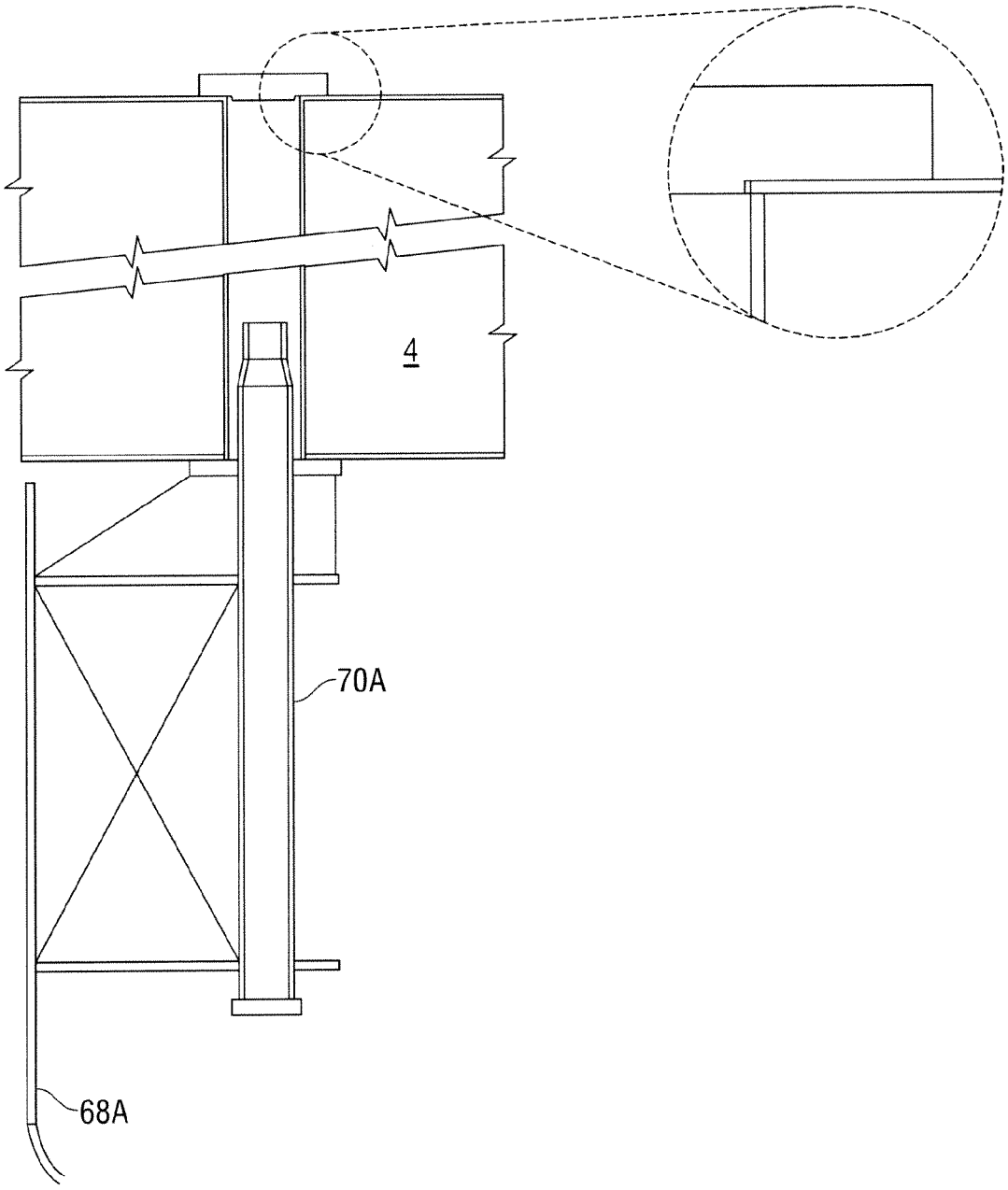
FIG. 25B is an elevational view of a thruster cover guide disposed with a thruster cover, with one end of the guide disposed in a pontoon.
Figure 25C:
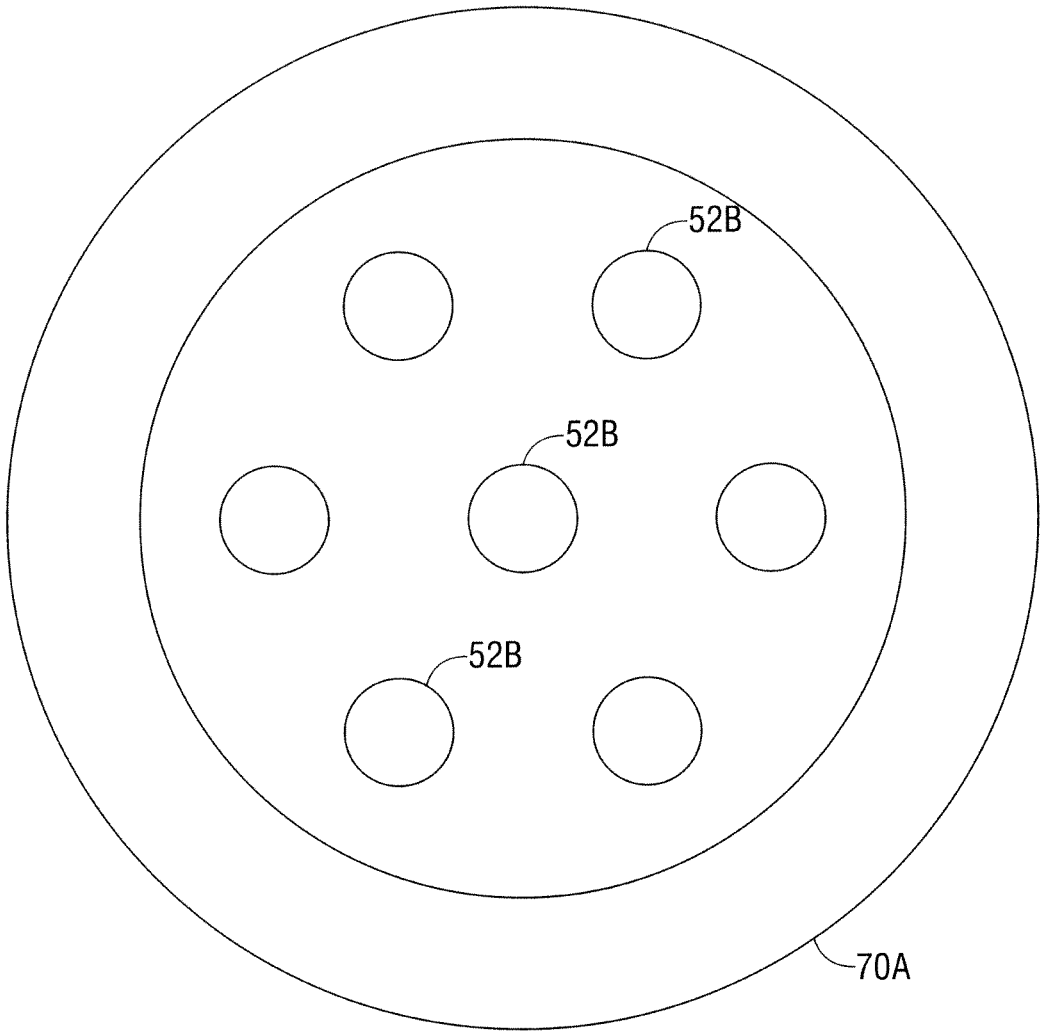
FIG. 25C is a cross-section view of tendons in a thruster cover guide.

In FIGS. 25-25A, two thruster covers 68A are disposed together, such as for placement over thruster assemblies 8 (one shown on right in FIG. 25) positioned near each other. Other shapes, sizes, dimensions, and designs of thruster covers are contemplated. Other types of attachment means between the two thruster covers 68A are contemplated. The guides 70A are positioned with the covers 68A. In FIG. 25B, the thruster cover guide 70A is disposed with the thruster cover 68A, with one end of the guide 70A disposed in the pontoon 4. As can now be understood, the guides 70A may be used to accurately position the cover 68A with the pontoon 4. In FIG. 25C, a plurality of tendons 52B are in thruster cover guide 70A.

Figure 26:
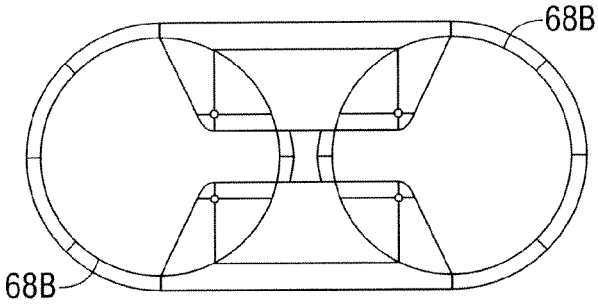
FIG. 26 is a plan view of two thruster covers disposed together.
Figure 26A:
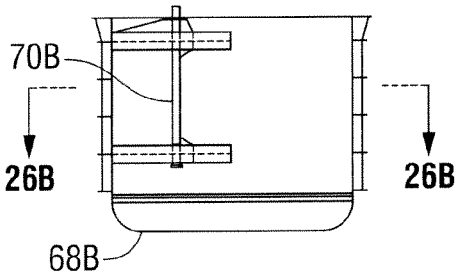
FIG. 26A is a section view along line 26A-26A of FIG. 26D showing a thruster cover guide of one of the thruster covers of FIG. 26.
Figure 26B:
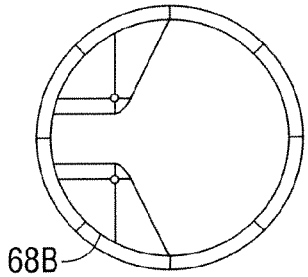
FIG. 26B is a section view along line 26B-26B of FIG. 26A.
Figure 26C:
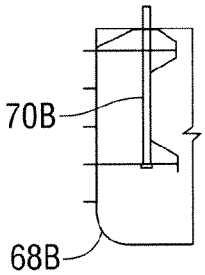
FIG. 26C is a section view along line 26C-26C of FIG. 26D showing a thruster cover guide of one of the thruster covers of FIG. 26.
Figure 26D:
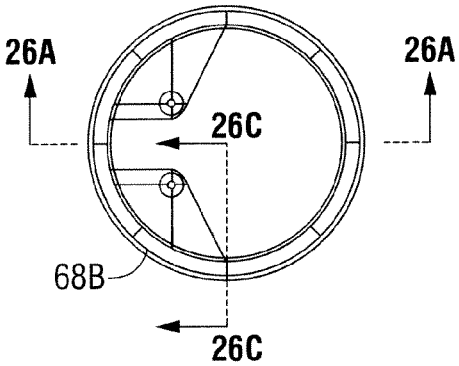
FIG. 26D is a top view of one of the thruster covers of FIG. 26.
Figure 27A:
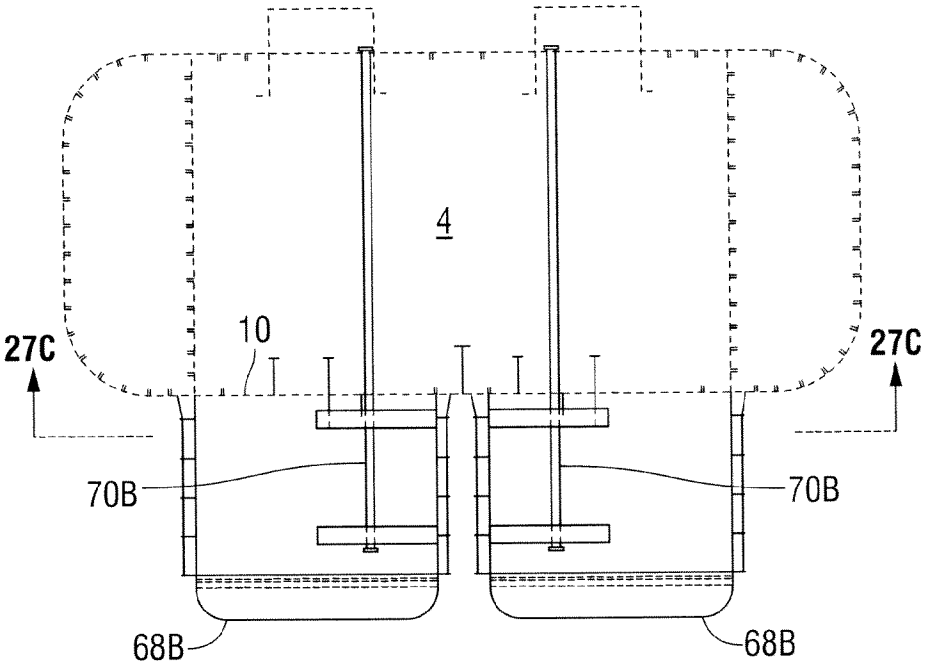
FIGS. 27A is a section view along line 27A-27A in FIG. 27 showing thruster cover guides disposed with thruster covers.
Figure 27:
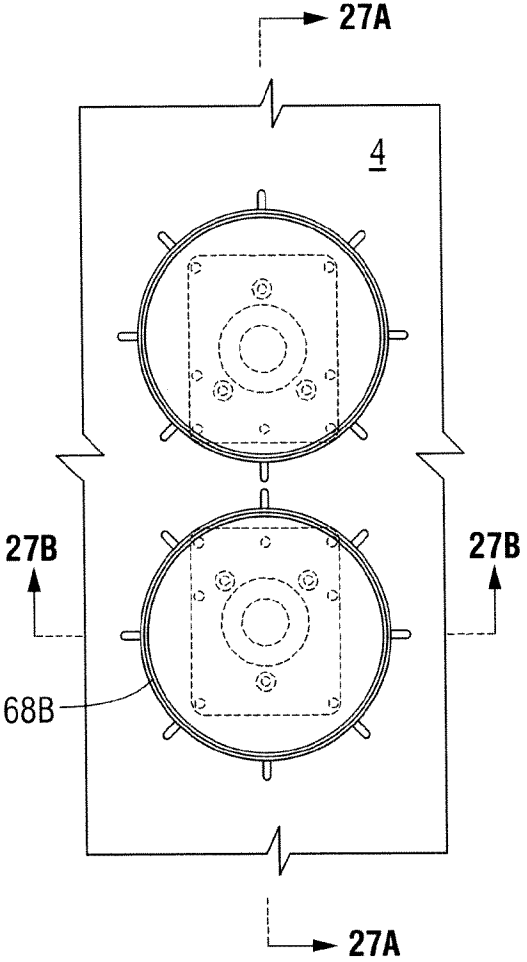
FIG. 27 is a bottom view of two thruster covers disposed with a pontoon.
Figure 27B:
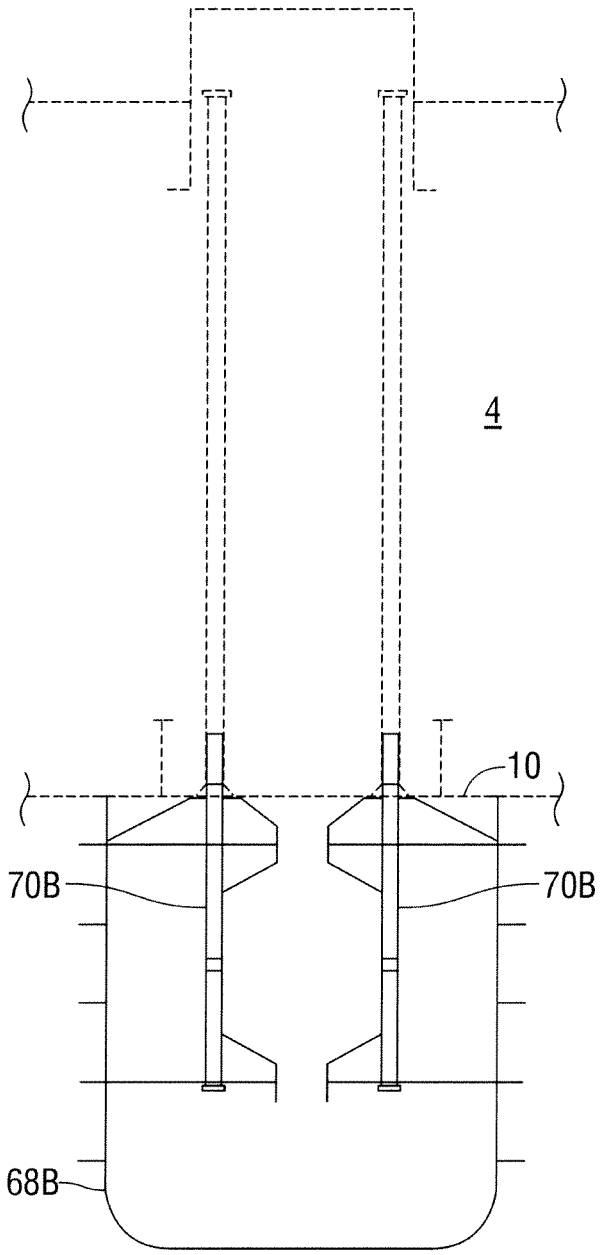
FIGS. 27B is a section view along line 27B-27B in FIG. 27.
Figure 27C:
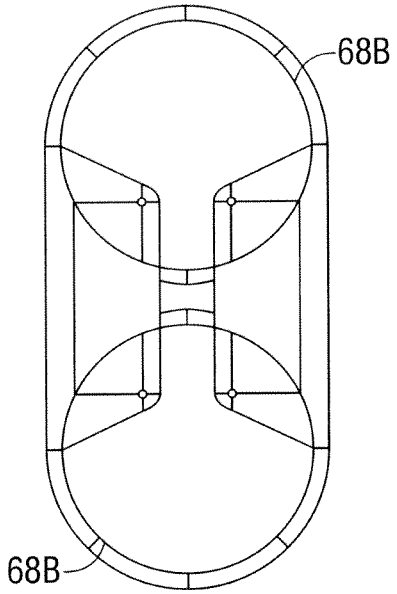
FIG. 27C is a section view along line 27C-27C of FIG. 27A of the two thruster covers.
Figure 28:
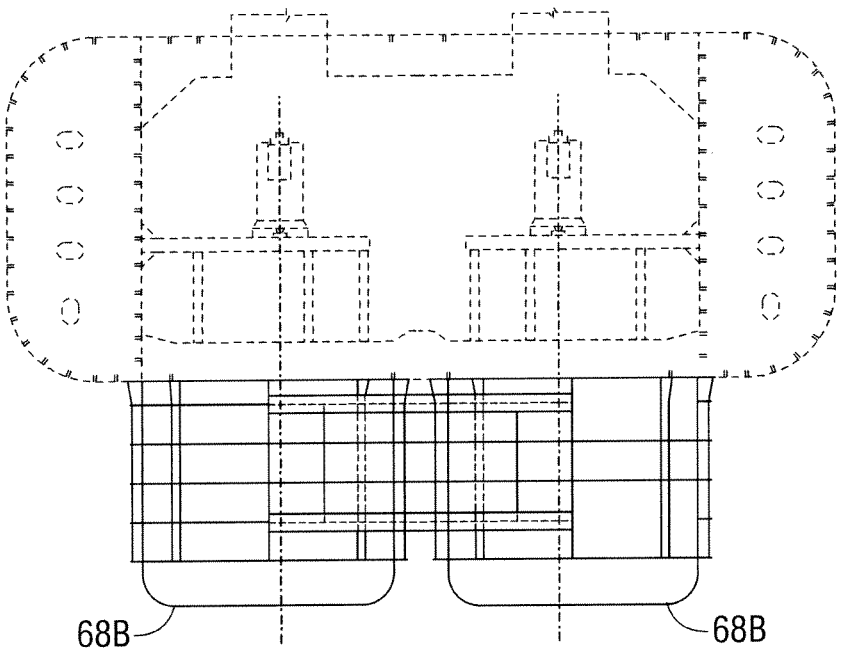
FIG. 28 is an elevational view of the two thruster covers and pontoon of FIG. 27.

Turning to FIG. 26, two thruster covers 68B are disposed together, such as for placement over the thruster assemblies 8 (not shown) positioned near each other. The thruster covers 68B may be made of a durable material such as steel, although other materials are contemplated. Other shapes, sizes, dimensions, and designs of the thruster covers are contemplated. Other types of attachment means between the two thruster covers 68B are contemplated. In FIGS. 26A-26D, the thruster cover guides 70B are disposed with the thruster covers 68B. In FIGS. 27-27C and 28, the two thruster covers 68B are positioned with the pontoon 4 using the guides 70B.

Elevating the Thruster Assembly

The higher the thruster is above the waterline, the lower the exposure to wave forces and other obstacles in the ocean. A cribbing wood (one foot or 30.5 cm in height) is typically positioned between the HTV 6 deck and the bottom surface 10 of the pontoon 4 with the thruster assemblies 8 hanging over the side of the HTV 6. However, using grilling instead, the distance from the thrusters to the water surface can be lengthened. For example, a grillage of two (2) meter height instead of the cribbing of one foot height may have a significant effect on thruster exposure to wave forces. However, having the semi-submersible vessel 2 elevated above the HTV 6 deck may provide challenges to stability as well as strength. Using a spacer barge beneath the semi-submersible vessel 2 solves the stability and strength problems as well as decreasing the draft of the semi-submersible vessel 2 during loading, which may sometimes be a problem.

Figure 29:
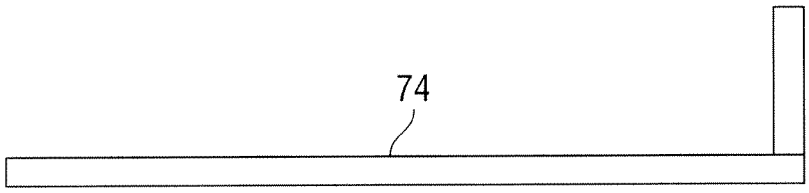
FIG. 29 is an elevational view of a spacer barge that has not been modified for use in elevating a semi-submersible vessel.
Figure 29A:
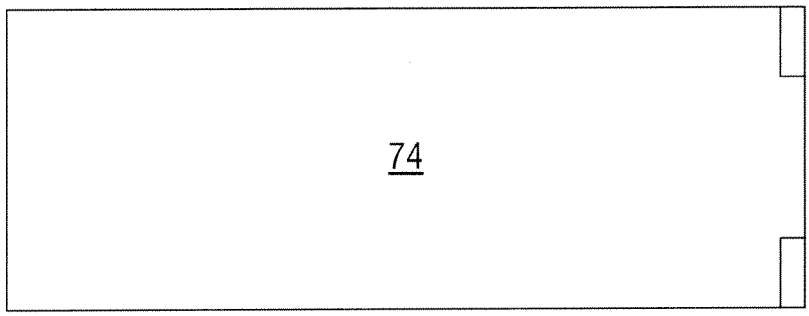
FIG. 29A is a plan view of the spacer barge of FIG. 29.
Figure 29B:
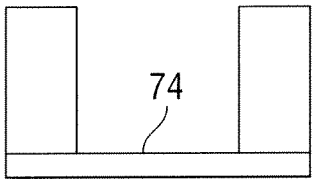
FIG. 29B is a front view of the spacer barge of FIG. 29.
Figure 30:
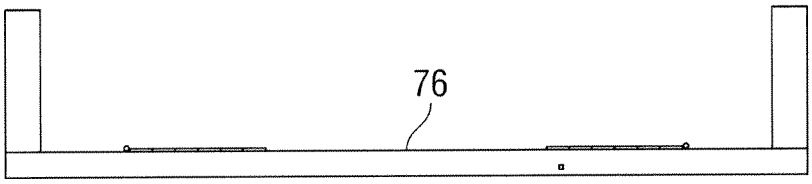
FIG. 30 is an elevational view of a spacer barge that has been modified for use in elevating a semi-submersible vessel.
Figure 30A:
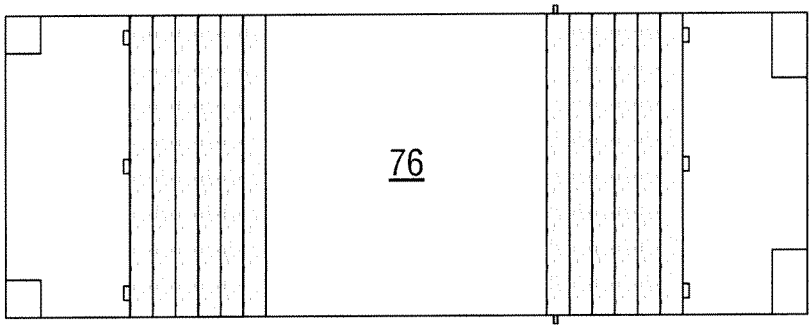
FIG. 30A is a plan view of the spacer barge of FIG. 30.
Figure 30B:
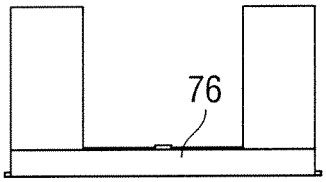
FIG. 30B is a front view of the spacer barge of FIG. 30.

Turning to FIGS. 29-29B, a spacer barge 74 is shown that has not been modified for use in elevating a semi-submersible vessel 2. FIGS. 30-30B show a spacer barge 76 that has been modified for use in elevating a semi-submersible vessel 2. Modifications may include the positioning of timber or similar material on the barge deck. Casing may be added. Cylindrical marine fenders may be added. Stoppers may be added. Other modifications are contemplated.

The spacer barge 76 or grillage may be positioned underneath a pontoon 4 between thruster assemblies 8. The barge 76 will lift the rig 2 to a lower draft. The barge 76 will position the thrusters 8 higher above the waves. The barge 76 will also allow for rotation of the rig 2 so as to position the thrusters 8 directly over the deck of the HTV 6 if the design of the HTV allows. It is contemplated that the barge 76 or grillage may be at least the height of the protrusion of the thrusters 8 underneath the rig 2. It is contemplated that the barge may allow at least part of the thruster assembly to be at a higher elevation than the HTV deck.

Figure 31:
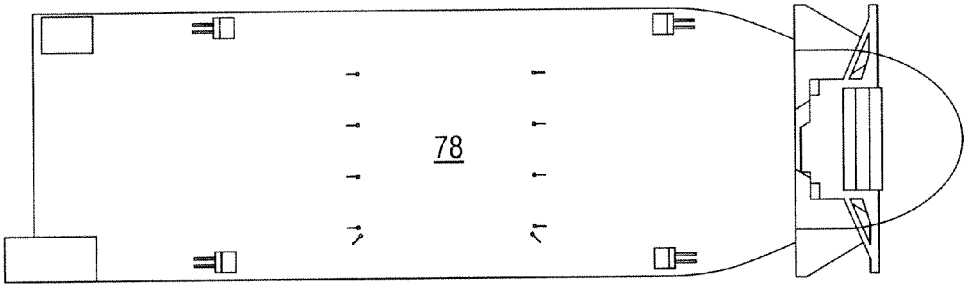
FIG. 31 is a plan view of a HTV for use with a spacer barge.
Figure 31A:
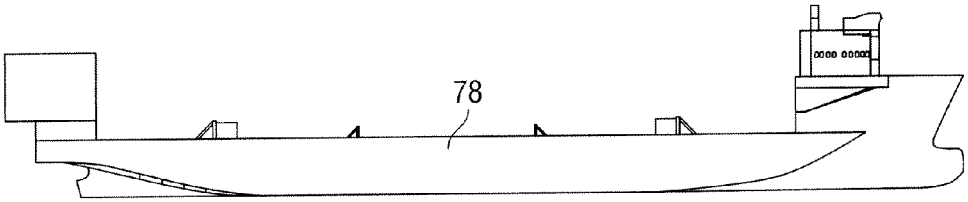
FIG. 31A is an elevational view of FIG. 31.
Figure 32:
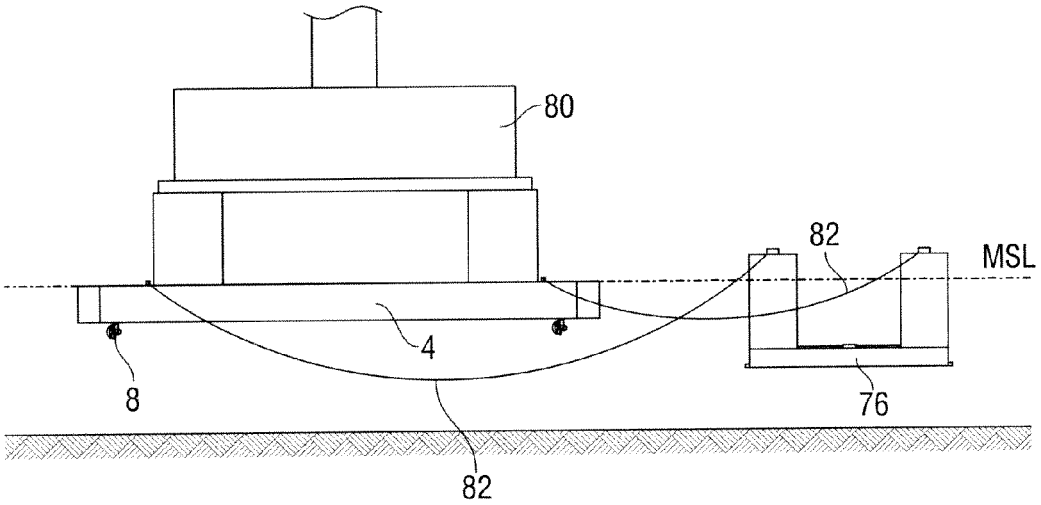
FIG. 32 is an elevational view of two tendons attached with and disposed between a semi-submersible vessel or rig and a spacer barge.
Figure 33:
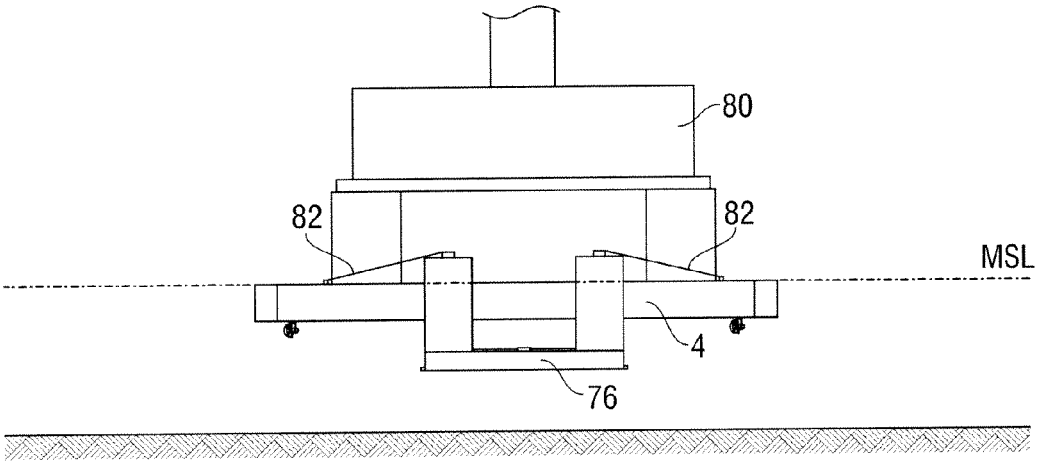
FIG. 33 is an elevational view of a spacer barge positioned with tendons below the semi-submersible rig.
Figure 34:
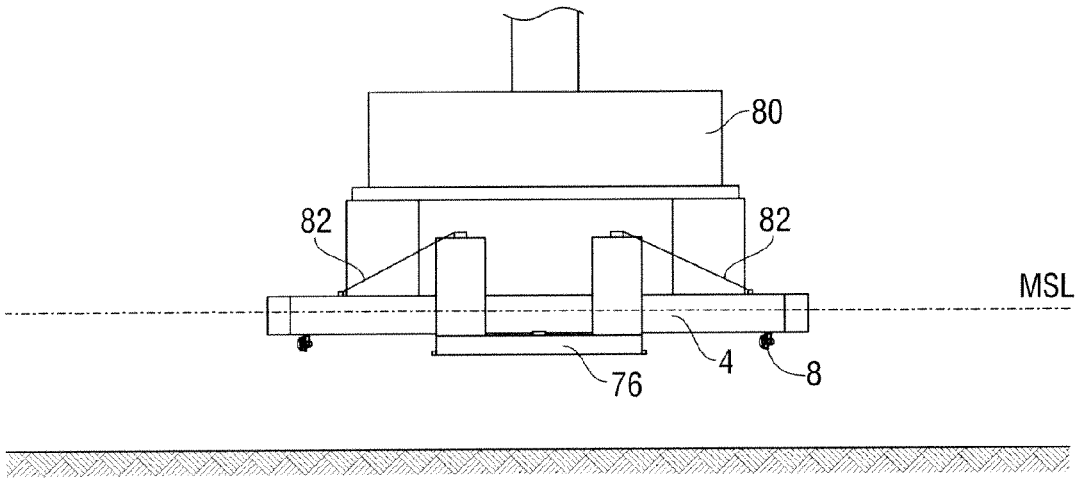
FIG. 34 is an elevation view of the buoyancy of the spacer barge lifting the rig.
Figure 34A:
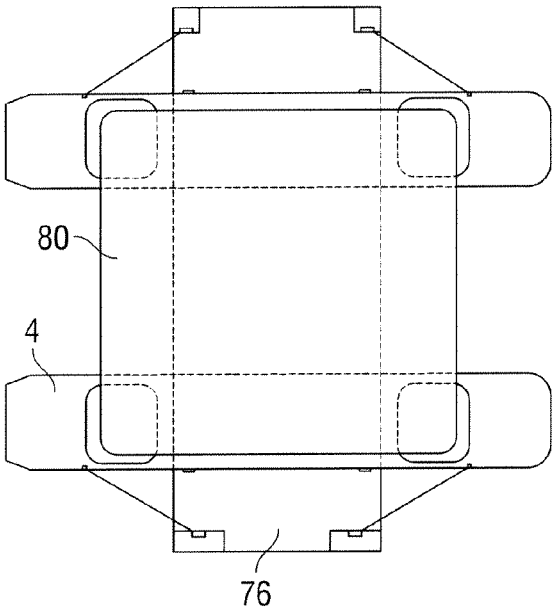
FIG. 34A is a plan view of FIG. 34.
Figure 35:
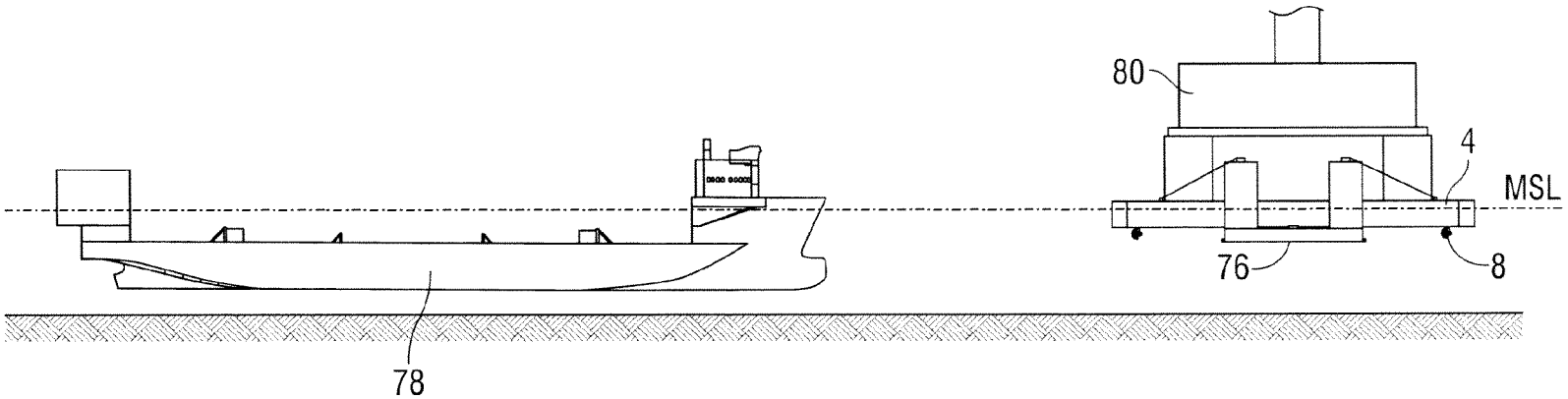
FIG. 35 is an elevational view of a HTV positioned adjacent the spacer barge with supported drilling rig.
Figure 36:
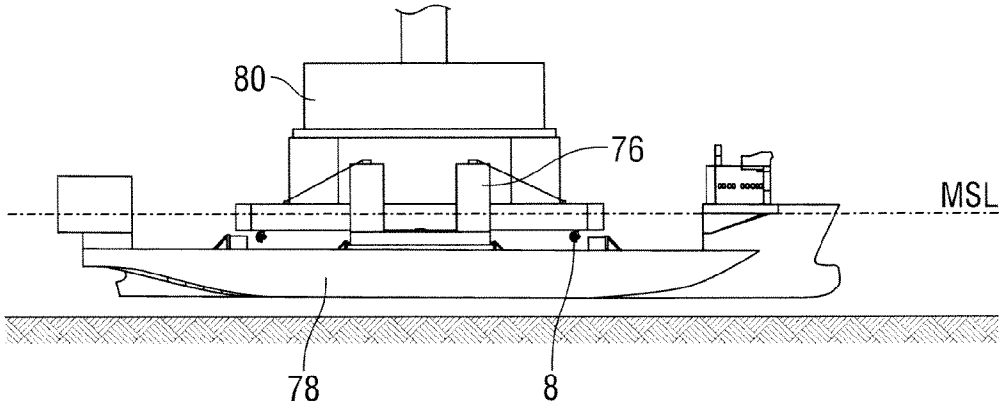
FIG. 36 is an elevational view of the spacer barge with rig positioned over the deck of the HTV.
Figure 37:
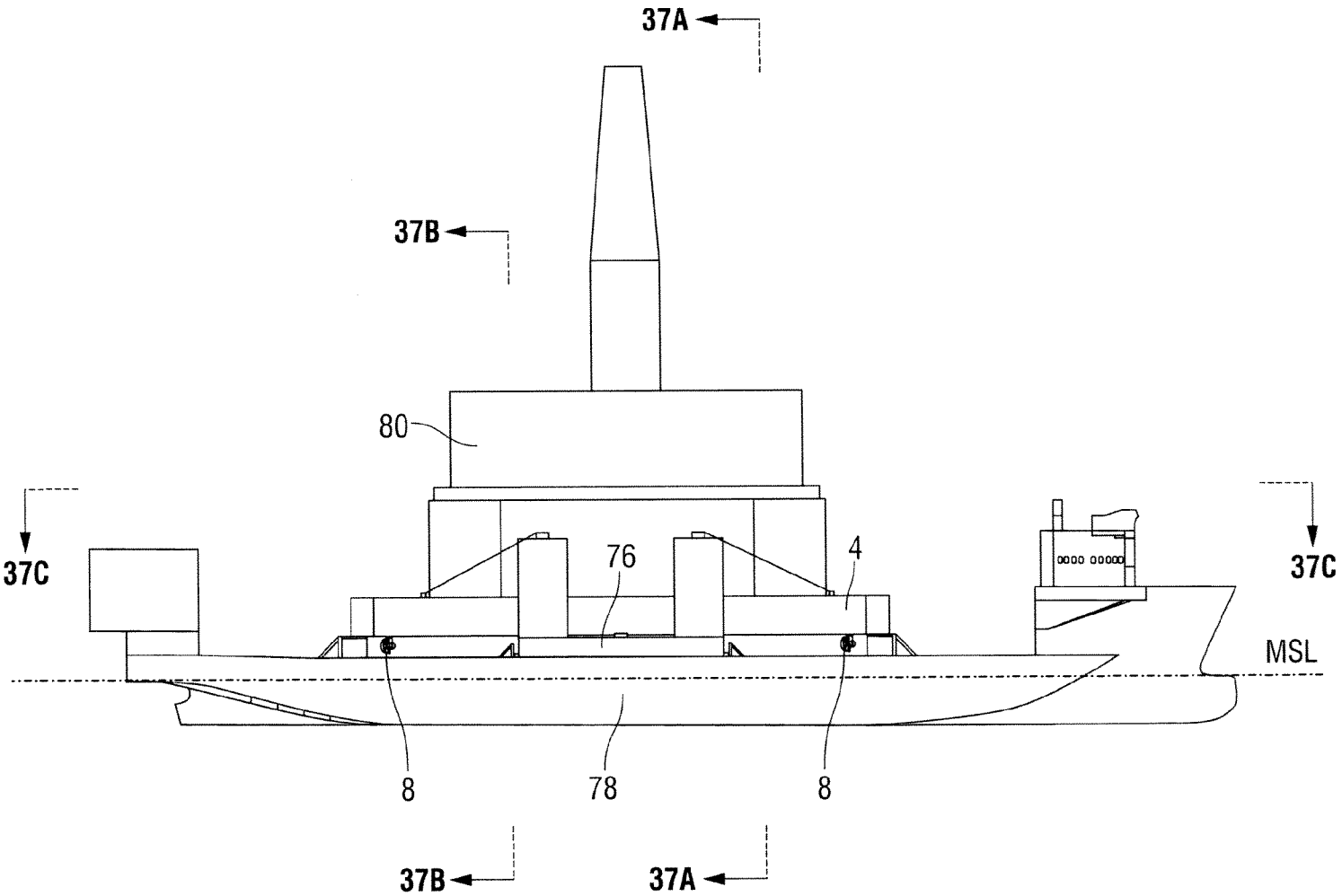
FIG. 37 is an elevational view of the spacer barge with rig positioned on the deck of the HTV with the thrusters above the surface of the water and over the deck of the HTV.

FIGS. 31-31A show one HTV 78 for use with spacer barge 76. FIGS. 32-37 illustrate one embodiment of a method for use of the spacer barge 76 with HTV 78. Other steps or methods are contemplated. In FIG. 32, tendons 82 are attached with the semi-submersible vessel or rig 80 and the spacer barge 76. In FIG. 33, the spacer barge 76 is positioned with the tendons 82 below the rig 80. In FIG. 34, the buoyancy of the spacer barge 76 lifts the rig 80. In FIG. 35, the HTV 78 is positioned adjacent the spacer barge 76 that is supporting the drilling rig 80. In FIG. 36, the spacer barge 76 with rig 80 is positioned over the deck of the HTV 78. In FIG. 37, the spacer barge 76 with the rig 80 is positioned on the deck of the HTV 78 with the thrusters 8 above the surface of the water.

Figure 37A:
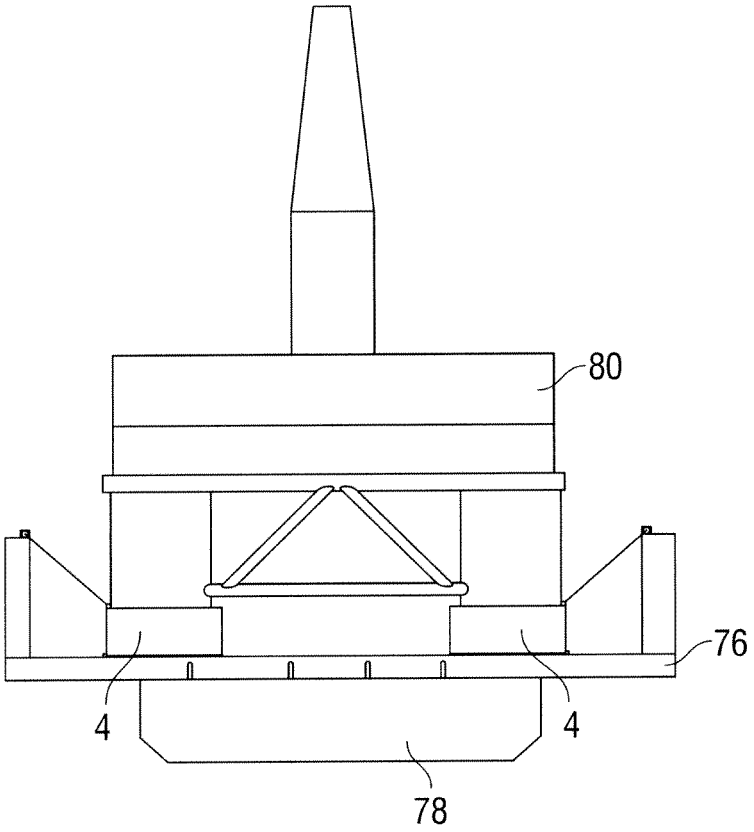
FIG. 37A is a section view along line 37A-37A of FIG. 37.
Figure 37B:
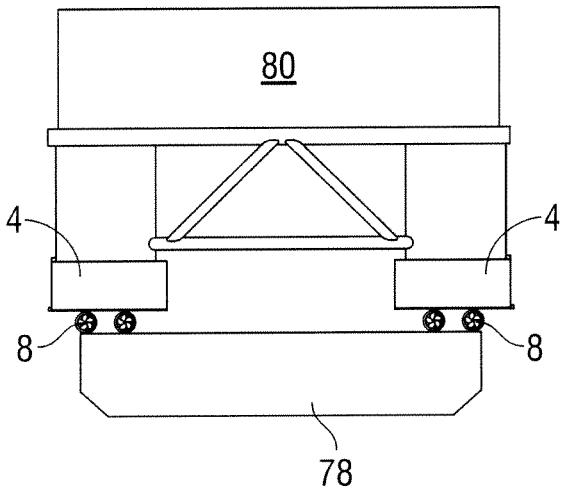
FIG. 37B is a section view along line 37B-37B of FIG. 37.
Figure 37C:
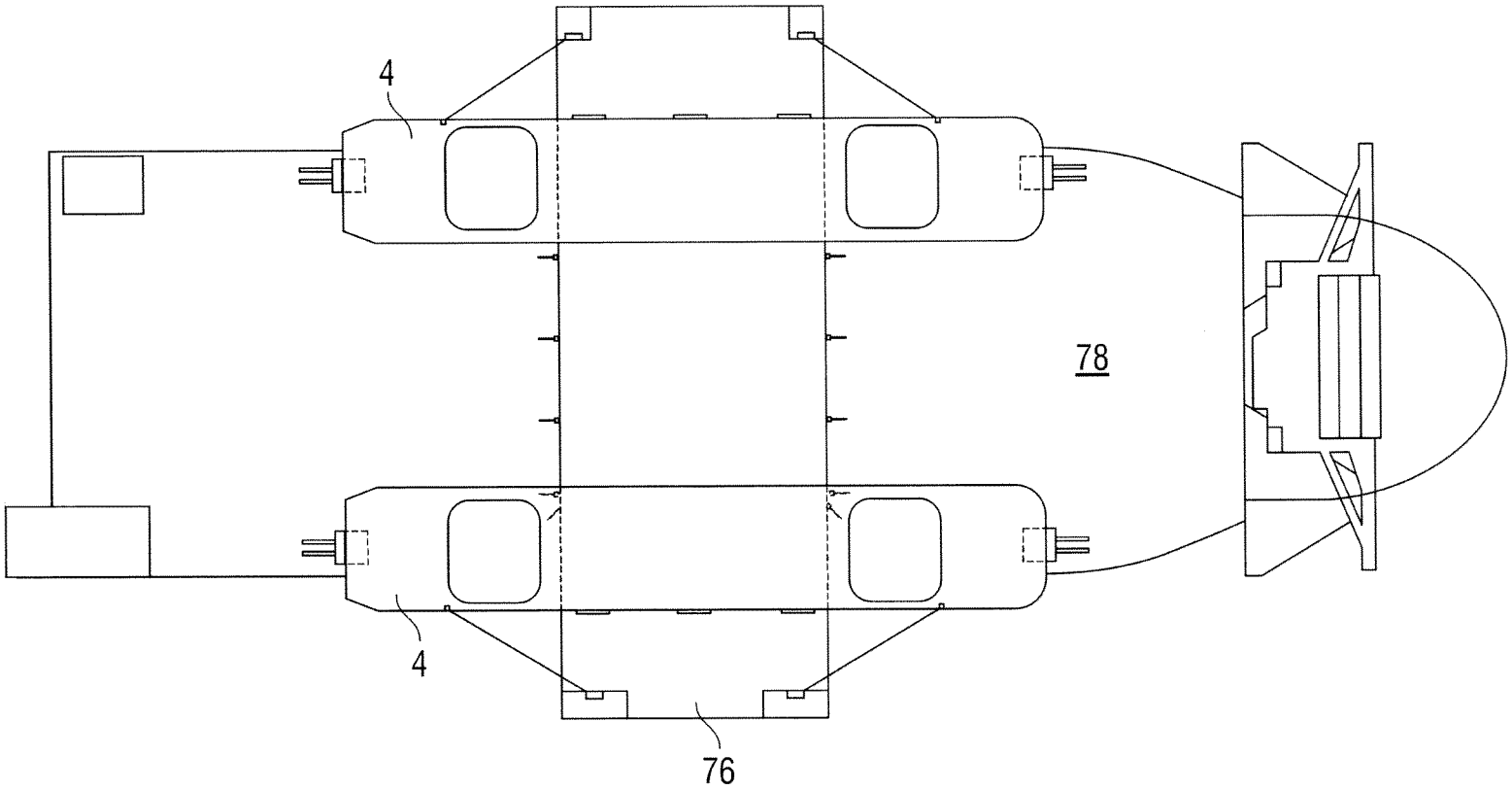
FIG. 37C is a section view along line 37C-37C of FIG. 37.
Figure 38:
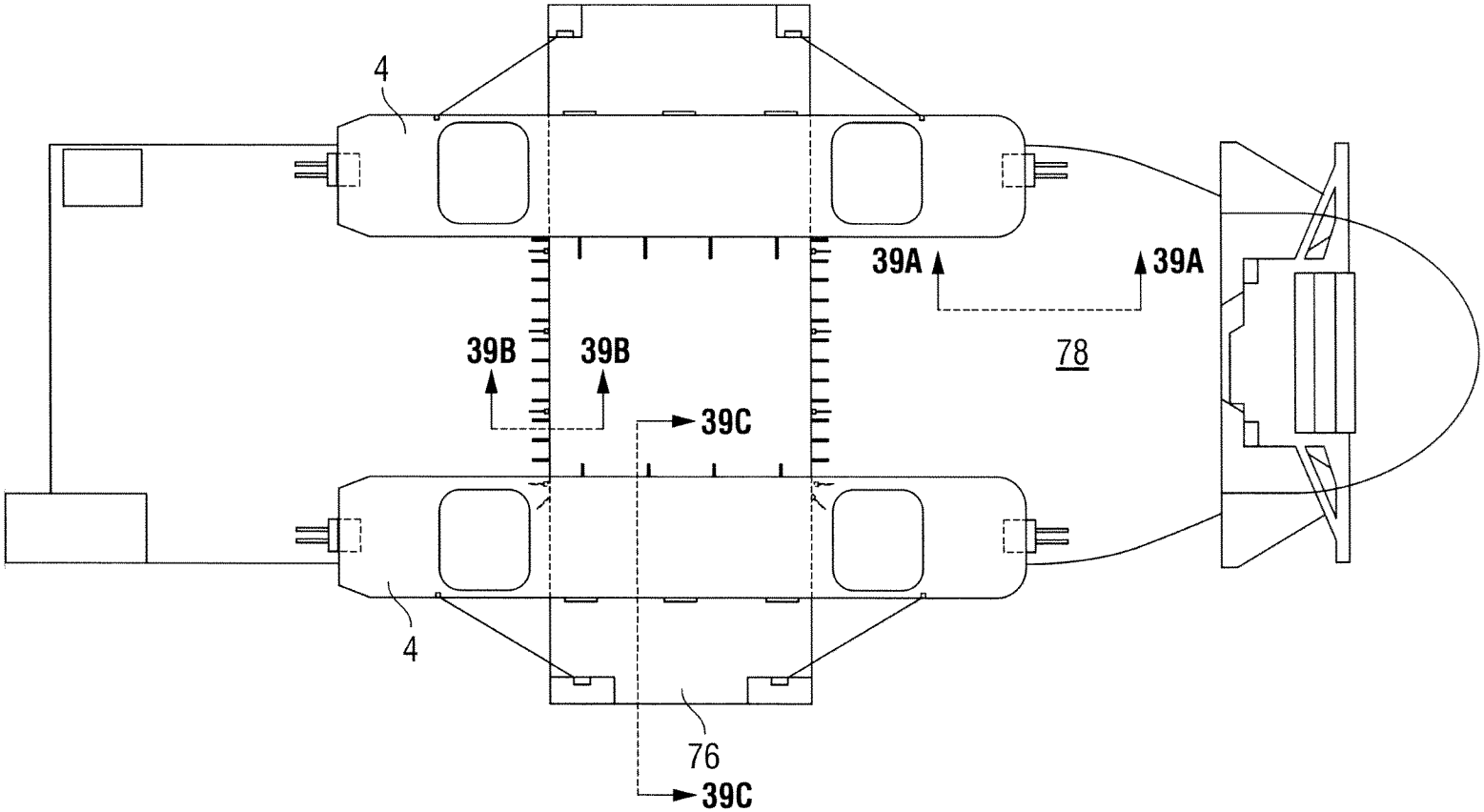
FIG. 38 is a top view similar to FIG. 37C showing rig tie down locations.
Figure 39A:
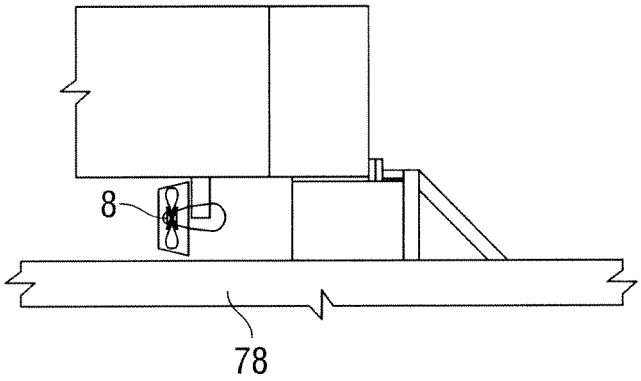
FIG. 39A is a detail view of rig tie downs on line 39A-39A of FIG. 38.
Figure 39B:
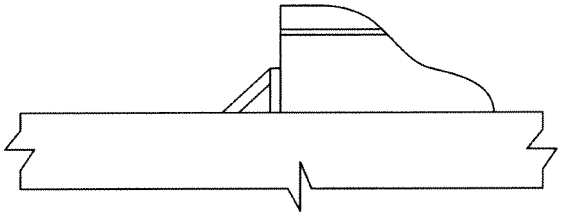
FIG. 39B is a detail view of rig tie downs on line 39B-39B of FIG. 38.
Figure 39C:
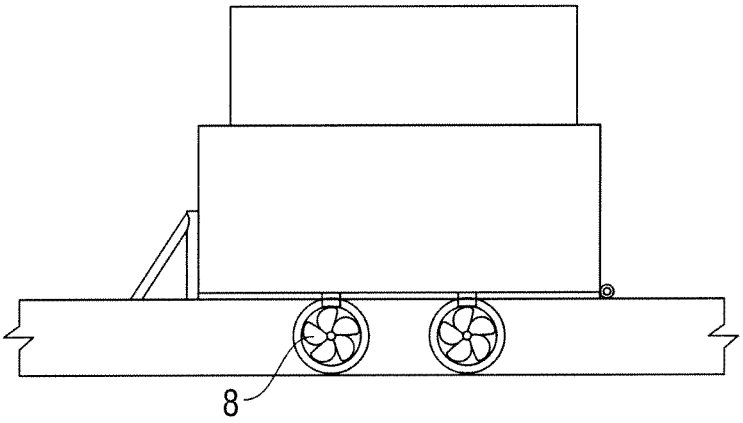
FIG. 39C is a detail view of rig tie downs on line 39C-39C of FIG. 38.

As can now be understood, the spacer barge 76 may allow for dry transport of the rig 80 without the thrusters 8 hanging over the side of the HTV. The spacer barge 76 also allows for the thrusters 8 to be elevated higher than the HTV deck. FIGS. 37A-37C show section views. In FIG. 37B, the thrusters 8 are directly above the HTV 78 deck. In FIG. 38, rig tie down locations are shown. FIGS. 39A-39C are detail views of the tie downs. In FIG. 39A, the thruster 8 is over the HTV 78.

Figure 40:
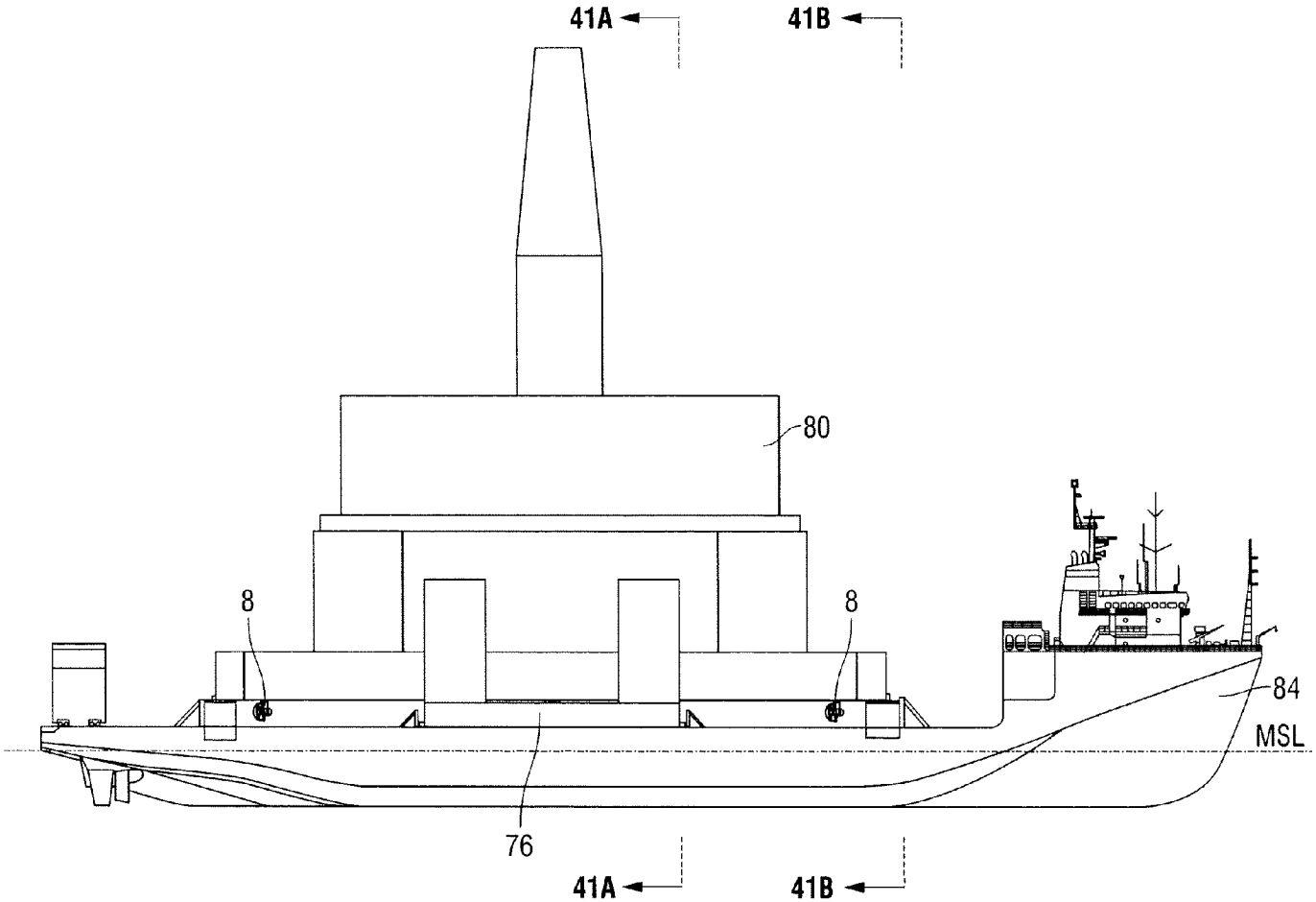
FIG. 40 is an elevational view of a spacer barge with a supported semi-submersible rig positioned on the deck of an HTV, which HTV is a different design than the HTV in FIGS. 31-37, with the thrusters above the surface of the water.
Figure 41B:
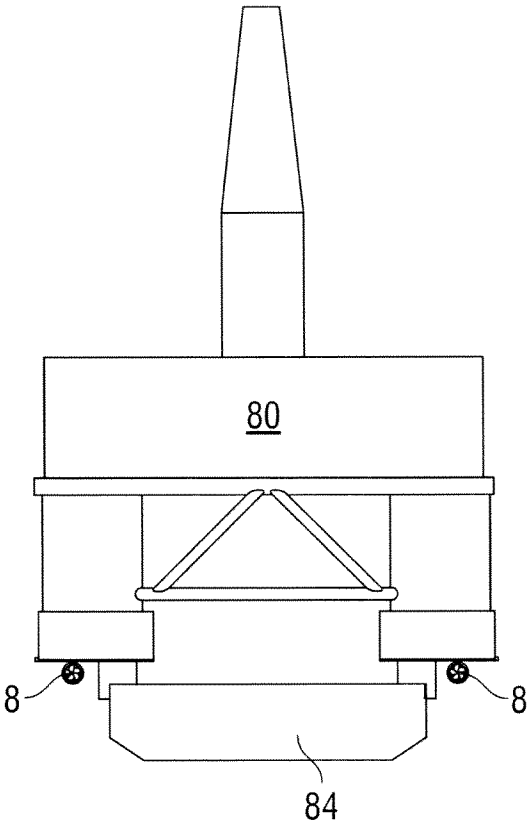
FIG. 41B is a section view along line 41B-41B of FIG. 40.
Figure 41A:
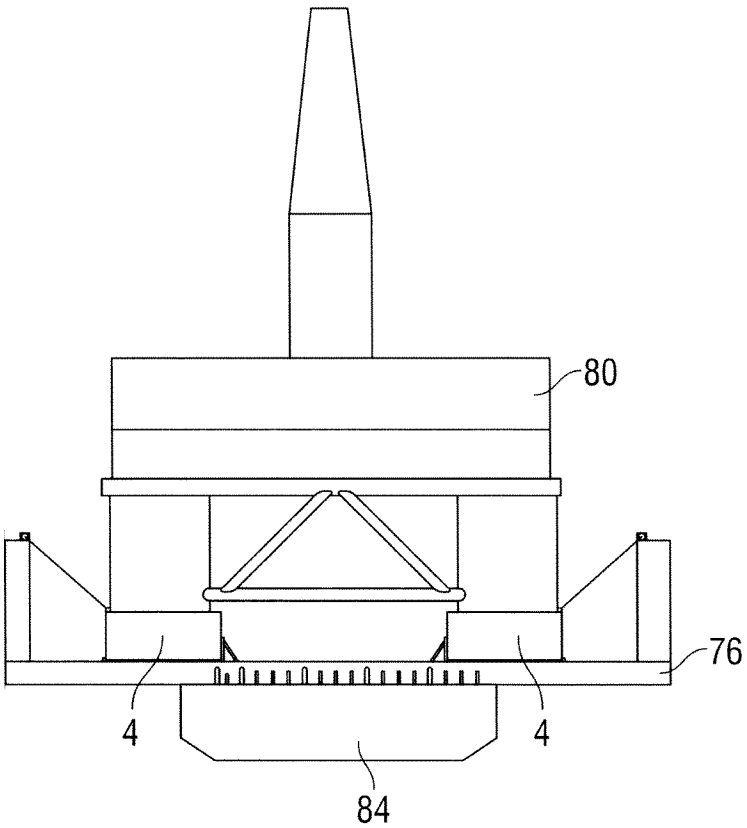
FIG. 41A is a section view along line 41A-41A of FIG. 40.
Figure 42:
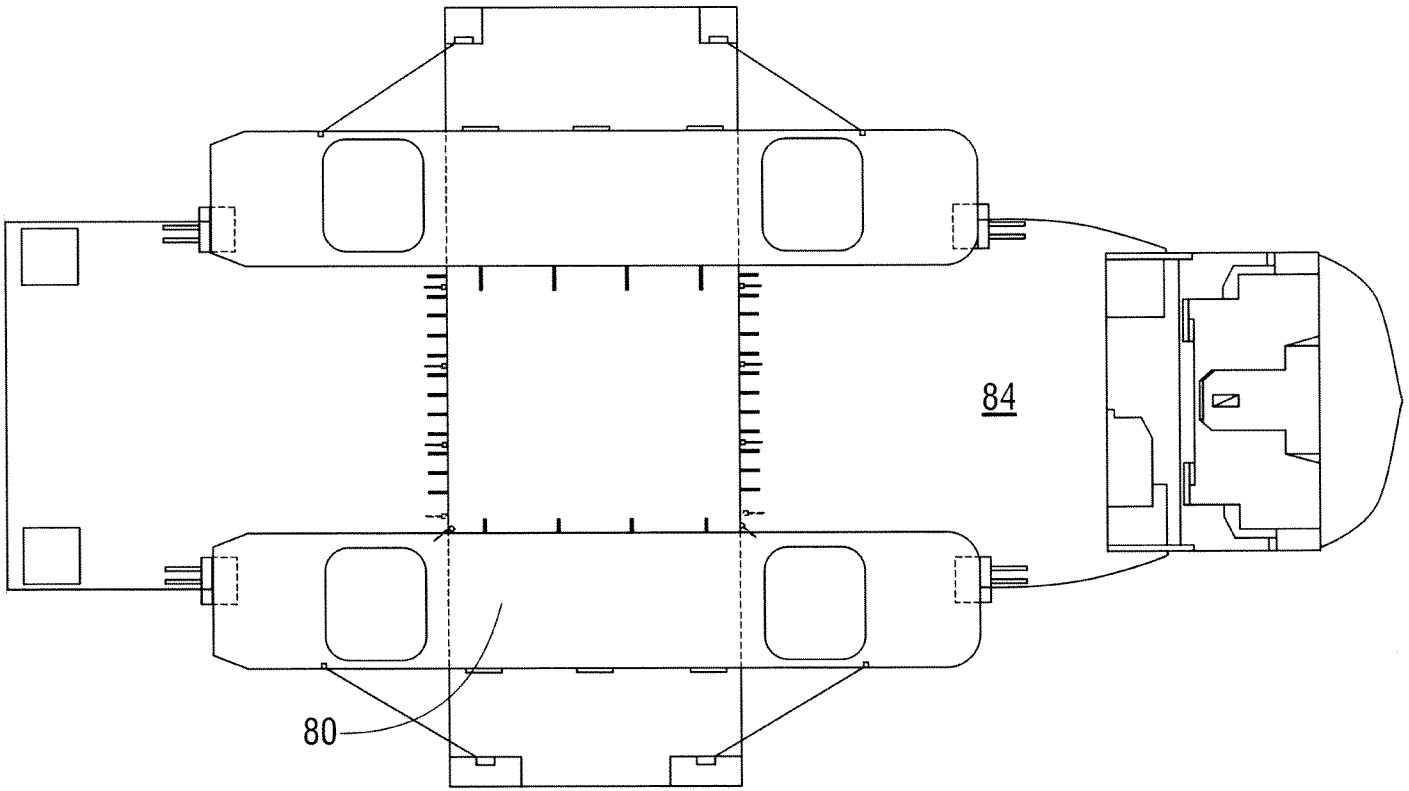
FIG. 42 is a top view of FIG. 40.

In FIG. 40, the spacer barge 76 with the semi-submersible rig 80 is positioned on the deck of a HTV 84. The HTV 84 is a different design than the HTV 78 in FIGS. 31-37. Returning to FIG. 40, the thrusters 8 are above the surface of the HTV 84 deck. In FIG. 41B, the thrusters 8 are lifted in elevation over the HTV 84 deck, but the thrusters 8 are not directly over the HTV 84 deck. The width of the HTV 84 deck in FIG. 41B is less than the width of HTV 78 deck in FIG. 37B. In FIG. 42, the rig 80 is disposed on the deck of HTV 84.

As can now be understood, a spacer barge may be used to elevate the thrusters 8 on the deck of the HTV. It is contemplated that the thrusters 8 may be positioned at a higher elevation than the deck of the HTV. However, whether the thrusters may be positioned directly over the HTV may depend on the design of the HTV, such as the width of the HTV deck. It is contemplated for all embodiments that to save additional time the thruster covers may be installed over the thruster assemblies 8 while the pontoons 4 of the semi-submersible drilling vessel are still in the water.

The foregoing embodiments address the root causes of the problem. Some embodiments increase the distance between the thruster assemblies and the water surface, minimizing or eliminating the exposure to the damaging wave forces. Other embodiments allow for the absorption of the wave forces at least in part with a thruster cover and transfer of the forces to or through the pontoon, such as with a thruster cover support structure.

The foregoing disclosure and description of the invention are illustrative and explanatory thereof, and various changes in the details of the illustrated apparatus and system, and the construction and the method of operation may be made without departing from the spirit of the invention.

We claim:

1. A system for protecting a thruster assembly secured with a bottom surface of a pontoon of a semi-submersible drilling vessel positioned on a second vessel, comprising:

a pontoon having a top surface with a top surface first opening and a bottom surface with a bottom surface first opening;

a first tendon through said top surface first opening, and said bottom surface first opening; and a thruster cover attached with said first tendon;

wherein said thruster cover is enclosing said thruster assembly.

2. The system of claim 1, further comprising:

said pontoon top surface having a top surface second opening and said pontoon bottom surface having a bottom surface second opening; and a second tendon through said top surface second opening and said bottom surface second opening;

wherein said thruster cover is attached with said second tendon.

3. The system of claim 1, wherein said thruster cover is a container having closed sides.

4. The system of claim 3, wherein said thruster cover is a plastic bag and said thruster assembly is surrounded with a fluid.

5. The system of claim 1, wherein said thruster cover is a container having partially closed sides.

6. A method for protecting a thruster assembly disposed with the bottom surface of a pontoon of a semi-submersible drilling vessel positioned on a second vessel, comprising the steps of:

providing a pontoon with a top surface having a top surface first opening and a bottom surface having a bottom surface first opening;

positioning a first tendon through said pontoon top surface first opening and said bottom surface first opening;

attaching said first tendon with a thruster cover; and securing said thruster cover over said thruster assembly with said first tendon.

7. The method of claim 6, further comprising the steps of:

providing a pontoon top surface second opening and a pontoon bottom surface second opening;

positioning a second tendon through said top surface second opening and said bottom surface second opening;

disposing said second tendon with said thruster cover; and securing said thruster cover over said thruster assembly with said second tendon.

8. The method of claim 6, further comprising the step of:

rotating said thruster assembly about a vertical axis before the step of attaching said first tendon with said thruster cover.

9. The method of claim 6, wherein said thruster cover is a container having closed sides.

10. The method of claim 9, wherein said thruster cover is a plastic bag, and further comprising the step of:

surrounding said thruster assembly in said thruster cover with a fluid.

11. The method of claim 6, wherein said thruster cover is a container having partially closed sides.

12. The method of claim 6, further comprising the step of:

floating said thruster cover below said thruster assembly before the step of securing said thruster cover over said thruster assembly with said first tendon.

* * * * *